US007075768B2

(12) United States Patent
Kaneko

(10) Patent No.: US 7,075,768 B2
(45) Date of Patent: Jul. 11, 2006

(54) FAUCET CONTROLLER

(75) Inventor: Yoshiyuki Kaneko, Fukuoka (JP)

(73) Assignee: Toto Ltd., Fukuoka (JP)

( * ) Notice: Subject to any disclaimer, the term of this patent is extended or adjusted under 35 U.S.C. 154(b) by 476 days.

(21) Appl. No.: 10/399,520

(22) PCT Filed: May 16, 2001

(86) PCT No.: PCT/JP01/04068

§ 371 (c)(1),
(2), (4) Date: Apr. 17, 2003

(87) PCT Pub. No.: WO02/40786

PCT Pub. Date: May 23, 2002

(65) Prior Publication Data

US 2004/0041110 A1 Mar. 4, 2004

(30) Foreign Application Priority Data

Nov. 14, 2000 (JP) ..... 2000-346472

(51) Int. Cl.
*H01H 47/00* (2006.01)

(52) U.S. Cl. ..... 361/160

(58) Field of Classification Search ..... 361/160
See application file for complete search history.

(56) References Cited

U.S. PATENT DOCUMENTS

| | | | | |
|---|---|---|---|---|
| 3,751,736 | A * | 8/1973 | Egli | 4/305 |
| 4,309,781 | A * | 1/1982 | Lissau | 4/304 |
| 6,061,843 | A | 5/2000 | Rump et al. | 4/302 |

FOREIGN PATENT DOCUMENTS

| | | | |
|---|---|---|---|
| CZ | 289 100 | | 9/2001 |
| DE | 44 10 993 | A1 | 5/1995 |
| EP | 0 675 234 | A1 | 4/1995 |
| JP | 2-65046 | U | 5/1990 |
| JP | 6-116991 | A | 4/1994 |
| JP | 6-37096 | Y2 | 9/1994 |
| JP | 6-67571 | U | 9/1994 |
| JP | 7-158130 | A | 6/1995 |
| JP | 8-511315 | A | 11/1996 |
| JP | 9-289704 | A | 11/1997 |
| JP | 9-289732 | A | 11/1997 |
| JP | 9-308121 | A | 11/1997 |
| JP | 10-161755 | A | 6/1998 |
| WO | WO 95/27103 | A1 | 10/1995 |

* cited by examiner

*Primary Examiner*—Stephen W. Jackson
(74) *Attorney, Agent, or Firm*—Birch, Stewart, Kolasch & Birch, LLP

(57) ABSTRACT

A controller apparatus for a faucet, for controlling the faucet using energy created by electric power generation, wherein all components used therein keep necessary performance thereof for a long period of time and wherein no components require exchange thereof until the product service-life of the faucet apparatus is reached, thereby realizing true maintenance-free apparatus. The controller apparatus for a faucet comprises a capacitor; a voltage conversion means for converting the capacitor voltage to a predetermined voltage; a faucet controller circuit operated with electricity supplied from the voltage conversion means; and an electromagnetic valve for opening or closing a flow passage by said faucet controller circuit. The controller apparatus for a faucet further comprises an electric power generation means and a primary battery, and the capacitor is charged with either of an output of the electric power generation means and the primary battery.

35 Claims, 16 Drawing Sheets

FAUCET CONTROLLER

This application is the national phase under 35 U.S.C. § 371 of PCT International Application No. FCT/JP01/04068 which has an International filing date of May 16, 2001, which designated the united States of America.

BACKGROUND OF THE INVENTION

1. Field of the Invention

The present invention relates to a controller apparatus for a faucet, and in particular relates to a controller apparatus including a function of electric power generation.

2. Discussion of the Background

The purpose of driving a controller apparatus for a faucet or tap by a function of electric power generation is to eliminate all engineering works and/or maintenances relating to a power supply of that apparatus. However, if the apparatus fails to operate or needs periodical exchange of components thereof, depending upon the condition of use, there is no purpose for providing the function of generating electricity.

The details of a related apparatus according to the conventional art can be seen in Japanese Utility Model Publication No. Hei 6-37096 (1994) and are described as follows:

In an apparatus, wherein the power generator is driven by an impeller which is provided within a flow passage of a faucet, so that a storage battery is charged with this power generator, and electricity is supplied to a faucet controller (a controller circuit) by means of the storage battery, there is provided a dry cell for unforeseen shortage in the charge of the storage battery, thereby to supply electricity to the faucet controller even from that dry cell. The dry cell is provided for the purpose of protecting the controller from stoppage of the operation thereof when the electric power generation comes down in shortage in an amount thereof.

According to such a conventional invention, the storage battery is provided as a main power supply for the controller circuit, while current providing power supply to the controller circuit is provided from the dry cell when the voltage of the storage battery is not sufficient. However, this arrangement has the following problems:

First, though the storage battery is applied in the main power supply, however, the number of usable years thereof, i.e., the service-life thereof, is short compared to other electronic components, for example, a resistor, a capacitor, etc. The storage battery is suitable for application in devices such as portable apparatuses, power tools, toys, etc., to which the dry cell is not well suited as a power supply and uneconomic since these devices have high power consumption. On the contrary, the storage battery is inherently not-suited for an application like a faucet apparatus, which is designed to be used for a long time with very little power consumption.

There are known various charging methods being appropriate for storage batteries, depending upon the kind thereof, such as charging with constant voltage, charging with low current, monitoring of change of temperature, etc. and also, there are restrictions of conditions for discharging thereof, such as current value, etc. If not operated according to such methods and/or conditions, the storage battery is over-charged or over-discharged, which tends to significantly deteriorate the performance thereof.

In the method of charging by means of the power generator driven when emitting water, since the time during which the power generation is conducted is short, a large amount of electric power is generated in an instant, and further the timing thereof is not predictable. Not seen in the conventional art, but in a case where a solar battery is applied as the power generator, a large amount of current flows continuously for several hours during clear weather, and this may continue for days. In the same manner, in a case where the electric power is generated by means of a thermal power generation element using the difference in temperature between hot water and cold water, it is difficult to control the power generation.

In any one of the cases of using such methods as the hydroelectric power generation, the solar battery and the thermal power generation, distinct from a case where a user intentionally charges the storage battery using a charger and so on, the charging conditions change variously depending upon the situations. It is difficult to satisfy a rule of charging which is recommended to avoid deterioration of the storage battery, and in such instances the shortening of the service-life of the storage battery can be unavoidable.

As is mentioned in the above, since there is applied the storage battery which in general is understood to not have a notably long service-life, and further since according to the possible conditions of use for this application it may be charged only through an inappropriate method, it is anticipated that the storage battery must be replaced within several years. Therefore, using the storage battery, since exchange of the storage battery will be necessary before the service-life of the faucet apparatus, it is impossible to achieve the purpose of the apparatus, i.e., its being maintenance-free. Therefore, it must be said that such use of the storage battery is not appropriate.

Also, according to the conventional art, the storage battery and the dry cell are connected in parallel with respect to the controller circuit, and electricity is conducted or supplied from either or both of the battery and the cell. The method, according to such a conventional art, is to switch the active source from among the battery and the cell depending upon the voltage difference between the battery and the cell, using diodes therein. However, this has such a problem, which will be mentioned below.

Using the storage battery and the dry cell in an exchangeable manner requires that the storage battery and the dry cell must be relatively equal in the performance or capacities thereof. Main consumption is the driving of an electromagnetic valve within the controller circuit for the faucet, and it is conventional to adopt one or several latching solenoids for keeping the electromagnetic valve in an OPEN- or CLOSE-condition in the faucet apparatus using the battery and the cell therein, however this necessitates a large amount of current being supplied in an instant. Therefore, in the conventional art, both the storage battery and the dry cell must be ones each having a capacity for supplying a large amount of current therefrom.

A long-term durable dry cell, having a service-life of 10 years, for example, has been developed for use in a gas meter, in which it is employed for a long time period using a very small amount of current. Because the internal resistance of the battery is large, it is therefore not suitable for the purpose of supplying a large amount of current therefrom. If such a large amount of current flows through, the dry cell is deteriorated and the service-life thereof comes to be about several years in the same manner as of the storage battery, thereby being contrary to the purpose, i.e., maintenance-free operation, of the electric power supply mentioned in the above.

Also, it is very difficult to clearly switch between the storage battery and the dry cell, in practice. Both the storage battery and the dry cell exhibit a lowering of the output voltage when the electric power remaining therein comes to be small, but the capacities thereof are variable depending on the kinds of the battery and the call. The capacities are changed depending on not only the remaining power, but also an environmental factor, such as the temperature, and the relative influence of such factors is also variable depending on the kind of the battery and the cell.

A nickel-cadmium battery in the conventional art is a type of the battery which has discharge characteristic being relatively flat, and it maintains the output of around 1.2 V during a discharge period thereof, but thereafter supplied voltage drops sharply. When voltage of the storage battery decreases sharply, the battery is in the condition where it is almost over-discharged, and also, the capacity of supplying current decreases remarkably, so that it is impossible to drive the controller circuit.

Therefore, it is necessary to switch from the storage battery to the dry cell before the former reaches an over-discharged state characterized by a sharp drop in available voltage, however since the duration of the condition wherein the nickel-cadmium battery maintains the constant battery voltage is long, both the dry cell and the storage battery are exhausted at the same time in most cases. Because the dry cell also changes the voltage gradually depending upon the remaining power in the cell, it is impossible to switch based on a boundary threshold set at a certain voltage, therefore it is impossible to escape from the fact that the dry cell is exhausted at the same time when the storage battery is exhausted.

Also, once the voltage of the storage battery decreases, a relatively large amount of charge is necessary to restore the output voltage. Therefore, the consumption of the dry cell is continued even if the power generation is conducted to the storage battery. Moreover, since the dry cell is also used for charging of the storage battery, it must share a loss of self-discharge of the storage battery and the heat generation when charging the storage battery. Therefore, the consumption of the dry cell comes to be greater, with most of the capacity of the cell being consumed once starting the operation thereof, and the service life of the dry cell therefore comes to be short.

With such a method according to the conventional art, because the electricity can be supplied to the controller circuit for the faucet from both the storage battery and the dry cell, the dry cell is inadvertently consumed, though it should be used primarily in a case where the remaining power of the storage battery is insufficient. Therefore, there is a possibility that the power remaining in the dry cell is insufficient when it is actually needed. Also, since it is impossible to determine whether either of the storage battery and the dry cell is actually used, an estimate cannot be made for a pace of consumption of the dry cell, and the dry cell must be replaced with new one, earlier with a margin. This is also, as is mentioned previously, contrary to the purpose of achieving the maintenance-free electric power supply by means of the electric power generation.

As is mentioned in the above, with the method of switching between the storage battery and the dry cell when conducting the electricity to the controller circuit, the storage battery and the dry cell reach the respective service-life thereof more quickly than under nominal applications thereof, depending on the characteristics of the battery and the cell which are actually used, and therefore it is impossible to achieve the apparatus's purpose of being maintenance-free.

Also, in the case where the hydroelectric generator including a water wheel and a power generator therein is provided as a power generation means, another problem arises additional to the problem limiting the maintenance-free requirement.

As a well-known characteristic of a power generator, when output current is drawn from the power generator, torque is generated due to electromagnetic force of this current in the direction preventing (opposite to) the rotation of the power generator. This means that the rotation of the water wheel, which is attached to the power generator, is prevented, and pressure loss in a portion of the hydroelectric generator is increased, thereby decreasing the flow rate of the faucet apparatus.

The generator is provided for the purpose of charging the storage means as the electric power supply for the faucet apparatus, and the flow rate of the faucet apparatus is set appropriately such that it outputs the charging current therefrom.

However, when the storage means is in a condition of being fully-charged and does not need any charge or is prohibited from charging, the current from the generator, being generated as the charge current until then, has no destination to flow to. In this instance, the output current of the generator comes to be zero (0), and the pressure loss in the portion of the hydroelectric generator is decreased while proportionally increasing the flow rate in the faucet apparatus.

In this manner, in the case of the hydroelectric power generation, the load current of the generator changes depending on whether it charges the storage battery or not, and there is a problem that the flow rate in the faucet apparatus changes without regard to the intention of a user.

For example, in Japanese Utility Model Laid-open No. Hei 2-65046 (1990), there is disclosed "connecting the power generator to the storage battery only when the storage battery is not yet fully charged". In this case, since the power generator loses the load when the storage battery is fully charged, the flow rate in the faucet rises abruptly when the charging of the storage battery is completed, as is mentioned previously.

SUMMARY OF THE INVENTION

The present invention is accomplished for solving such problems as mentioned above, and an object of the present invention is, in the faucet apparatus for controlling the faucet using energy of power generation conducted by the same apparatus, to provide a controller apparatus for a faucet, wherein all components used therein can maintain necessary performances thereof for a long time period, so that none of the components, such as the battery, etc., need to be exchanged until reaching the product service-life thereof, thereby realizing the true maintenance-free objective of the faucet apparatus.

Furthermore, in particular in a case of using hydroelectric power generation therein, an object of the present invention is to provide a controller apparatus for a faucet, enabling stable flow rate in spite of the charging condition of the storage means.

For achieving the above mentioned object, there is provided a controller apparatus for a faucet, comprising: a capacitor; a voltage conversion means for converting voltage across said capacitor to a predetermined voltage; a faucet controller circuit being operated with supply of electricity from said voltage conversion means; and an electromagnetic valve for opening or closing a flow passage by said faucet controller circuit, and further comprising: an electric power generation means; and a primary battery, wherein said capacitor is charged with either of an output of said electric power generation means and said primary battery, whereby any use of a component having short service life is avoided.

Also included is a charge controller means for controlling charging from said primary battery to said capacitor, thereby preventing deterioration of the primary battery caused by the discharging of large current.

Further, the charge controller means performs the control depending on the voltage across said capacitor, thereby preventing useless consumption of current from the primary battery and resultant exhaustion thereof.

The charge controller means has a function of restricting the supply of electricity from said primary battery to said faucet controller circuit, thereby enabling management of the consumption amount of the primary battery.

The charge controller means is a switching means, thereby achieving simplicity of the control.

In addition, charge controller means is an impedance changing means, thereby enabling the control with high accuracy.

The switching means breaks the connection between said primary battery and said capacitor depending on load current of said faucet controller circuit.

Also, the switching means breaks the connection between said primary battery and said capacitor when an output of said voltage conversion means decreases.

The switching means breaks the connection between said primary battery and said capacitor for a predetermined time after conduction of electricity into said electromagnetic valve.

Thus, it is possible to prevent deterioration of the primary battery caused by the discharging of large current, and to manage the consumption of the primary battery.

The impedance changing means changes impedance of the connection between said primary battery and said capacitor to high impedance depending on load current of said faucet controller means.

The impedance changing means changes impedance of the connection between said primary battery and said capacitor to high impedance when an output of said voltage conversion means decreases.

The impedance changing means changes impedance of the connection between said primary battery and said capacitor to high impedance for a predetermined time after conduction of electricity into said electromagnetic valve.

Thus, it is possible to prevent deterioration of the primary battery caused by the discharging of large current, and to manage the consumption of the primary battery, while controlling the charge time for the capacitor to the most appropriate time.

Further, the voltage conversion means is a switching type voltage conversion circuit, thereby enabling superior efficiency of the voltage conversion means regardless of the voltage of the capacitor.

Also, the voltage conversion means is a switching type voltage conversion circuit and said charge controller means is a resistor, whereby any need for controlling the charge controller means by a ,u computer, etc. is avoided.

The voltage conversion means is a switching type voltage conversion circuit, and the connection between said primary battery and said capacitor is broken when said switching type voltage conversion circuit performs a switching operation, thereby preventing deterioration of the primary battery caused by the discharging of large current, and enabling management of the consumption of the primary battery.

The voltage conversion means is a switching type voltage conversion circuit, and the impedance of the connection between said primary battery and said capacitor is changed to high impedance when said switching type voltage conversion circuit performs a switching operation, thereby preventing deterioration of the primary battery caused by the discharging of large current as well as managing the consumption of the primary battery, while controlling the charge time for the capacitor to the most appropriate time.

In addition, the voltage conversion circuit is a voltage booster circuit, whereby the primary battery may acceptably be low in voltage.

The impedance changing means is either of a series connection and a parallel connection of a resistor and a switching element, thereby enabling various changes of impedance by means of control of the switching element.

The impedance changing means performs ON/OFF control of a switching element, thereby enabling a smaller number of components, which is suitable for the control by a ,u computer, etc.

Also included is a discharge means for discharging said capacitor when voltage across said capacitor is equal to or greater than a predetermined voltage, thereby avoiding a drawback occurred when the output of the electric power generation means is too large.

The discharge means is constructed with a resistor and a switching element, enabling components to be low in cost and simple in the control thereof.

Also included is a human body detection means for detecting a user of the faucet, wherein the frequency of operations of said human body detection means is controlled depending on the voltage across said capacitor, whereby any necessity for additional components for the discharge means is avoided.

The electric power generation means is a hydroelectric generator provided within the flow passage of the faucet, whereby the electric power generation is carried out every time the faucet is used.

The electric power generation means is a solar battery provided on or in vicinity of a main body of the faucet, whereby the electric power generation is possible in the presence of light falling upon the solar battery.

Further, the electric power generation means is a thermal power generating element thermally connected to the flow passage of the faucet, whereby the electric power generation is carried out every time the faucet is used, and whereby the apparatus is superior in durability because no movable mechanical components are used therein.

The electric power generation means is a combination of at least two selected from a hydroelectric generator provided within the flow passage of the faucet, a solar battery provided on or in vicinity of a main body of the faucet, and a thermal power generating element thermally connected to the flow passage of the faucet, thereby enabling that configuration and flexibility of setup may be responsive to the condition where the apparatus is used.

The electric power generation means is constructed to be exchangeable with another electric power generation means, so that it is possible to change the faucet apparatus depending on the conditions after installation or setup thereof.

Further, at an output of said electric power generation means is provided an output voltage restriction circuit, so that it is possible to improve reliability when combining the electric power generation means.

Also included is an electric power consumption circuit, and an exchanger means for connecting either of said capacitor and said electric power consumption circuit to an output of the generator, thereby stabilizing the flow rate of the faucet.

The exchanger means is controlled depending on charge voltage of said capacitor, thereby enabling the charge control for the capacitor as well as the stabilization of the flow rate of the faucet.

Also included is a hydroelectric generator provided within a flow passage of the faucet; an electricity storage means charged by said generator; a faucet controller circuit operated with supply of electricity from said electricity storage means; and an electromagnetic valve for opening or closing the flow passage by said faucet controller circuit, and further comprising: an electric power consumption circuit; and an exchanger means for connecting either of said electric power consumption circuit and said electricity storage means to an output of said generator, so that output current from the generator is not interrupted and the flow rate of the faucet is stabilized.

Further, exchanger means performs the control depending on charge voltage of said electricity storage means, thereby enabling the charge control of the electricity storage means as well as the stabilization of the flow rate of the faucet.

BEST MODE FOR CARRYING OUT THE INVENTION

For better understanding thereof, the present invention will be explained in detail hereinafter.

Embodiment 1

Figure 1:
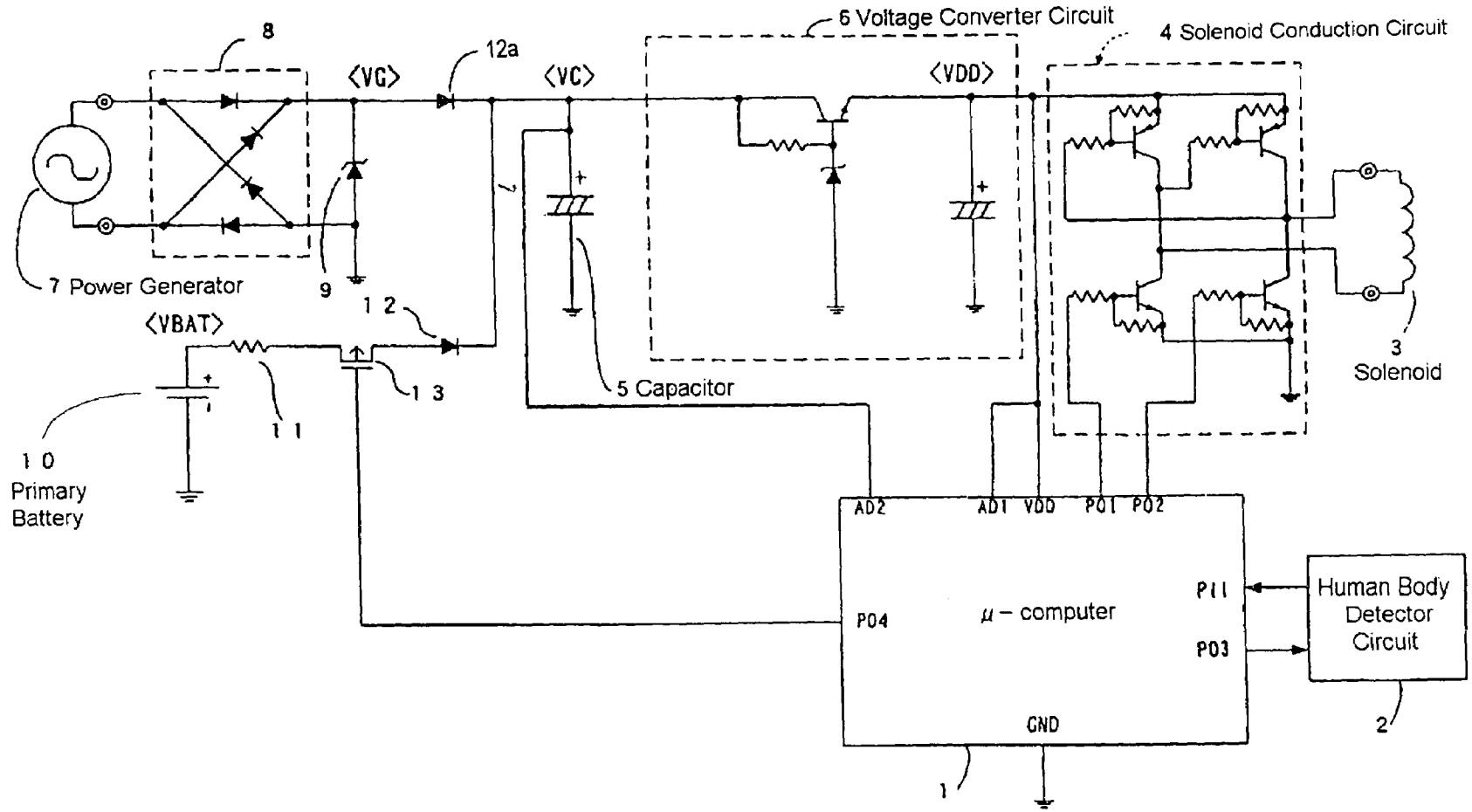
FIG. 1 is a circuit diagram of a first through third embodiments according to the present invention.

FIG. 1 is a circuit diagram for explaining a first embodiment of the present invention.

In FIG. 1, reference number 1 indicates a micro-computer (μ-computer) which comprises the basis of a faucet controller circuit for controlling a faucet apparatus, 2 a human body detector circuit for detecting a user of the faucet apparatus, 3 a solenoid of an electromagnetic valve for opening and/or closing a waterway of the faucet apparatus, and 4 a solenoid conduction circuit for conducting electricity to the solenoid 3.

The μ-computer 1, the human body detector circuit 2 and the solenoid conduction circuit 4 are components relating to the control of the faucet apparatus, and they together comprise a faucet controller circuit.

The human body detector circuit 2 is a sensor for detecting the proximity of a hand, if the faucet apparatus is applied to an automatic hand wash-basin, for example. The μ-computer 1 performs the detecting operation through a port PO3 thereof and outputs the detection result to a port PI1 thereof. It is not necessitated that the human body detector circuit 2 be a sensor. It may be a manual operation switch or a timer, for example, as far as it can be a control condition for the faucet apparatus.

The solenoid 3 is of a so-called latching type solenoid which does not consume current except for at the time of performing the action of an electromagnetic valve open/close. The solenoid conduction circuit 4 is an H-bridge circuit for conducting electricity into the solenoid 3 in a normal/reverse direction depending on an open/close action of the electromagnetic valve. The conduction of electricity for opening is performed when a port PO1 of the μ-computer 1 is Hi and the conduction of electricity for closing is performed when a port PO2 is Hi. Further, it is noted that the current conducted from the solenoid conduction circuit 4 may be overwhelmingly large with respect to that in the μ-computer 1 and the human body detector circuit 2.

As shown in FIG. 1, reference number 5 indicates a capacitor. Reference number 6 indicates a voltage converter circuit. The capacitor 5 and the voltage converter circuit 6 construct a power supply for the faucet controller circuit. The voltage converter circuit 6 is a constant voltage circuit of a voltage drop type, and it may be constructed not only according to the structure shown in FIG. 1, but also with a three (3) terminal regulator IC and a smoothing capacitor.

Reference number 7 is a power generator which is attached to a water wheel provided within the waterway. The output of the power generator 7 is used for charging the capacitor 5 through a diode 12*a* after being rectified by means of a full-wave rectifier 8. A constant voltage diode 9 is a protecting element for preventing the output of the full-wave rectifier 8 from exceeding the maximum rated voltage of the capacitor 5. The diode 12*a* prevents the capacitor 5 from being discharged by leakage current through the constant voltage diode 9.

Reference number 10 is a primary battery for charging the capacitor 5 through a resistor 11, a transistor 13 and a diode 12. The transistor 13 is turned ON/OFF through a port PO4 of the μ-computer 1, more specifically, it is turned ON when the PO4 is Lo. The diode 12 protects the primary battery 10 from being inversely charged.

Further, suppose that the output of the voltage converter circuit 6 which is also the power supply voltage of the faucet controller circuit is VDD and the voltage across the capacitor 5 is VC. In such a case, the VDD and the VC are inputted to A/D converter ports, i.e., AD1 and AD2 of the μ-computer 1, respectively. As a result of this, the μ-computer 1 can determine the respective values of the voltage.

Figure 2:
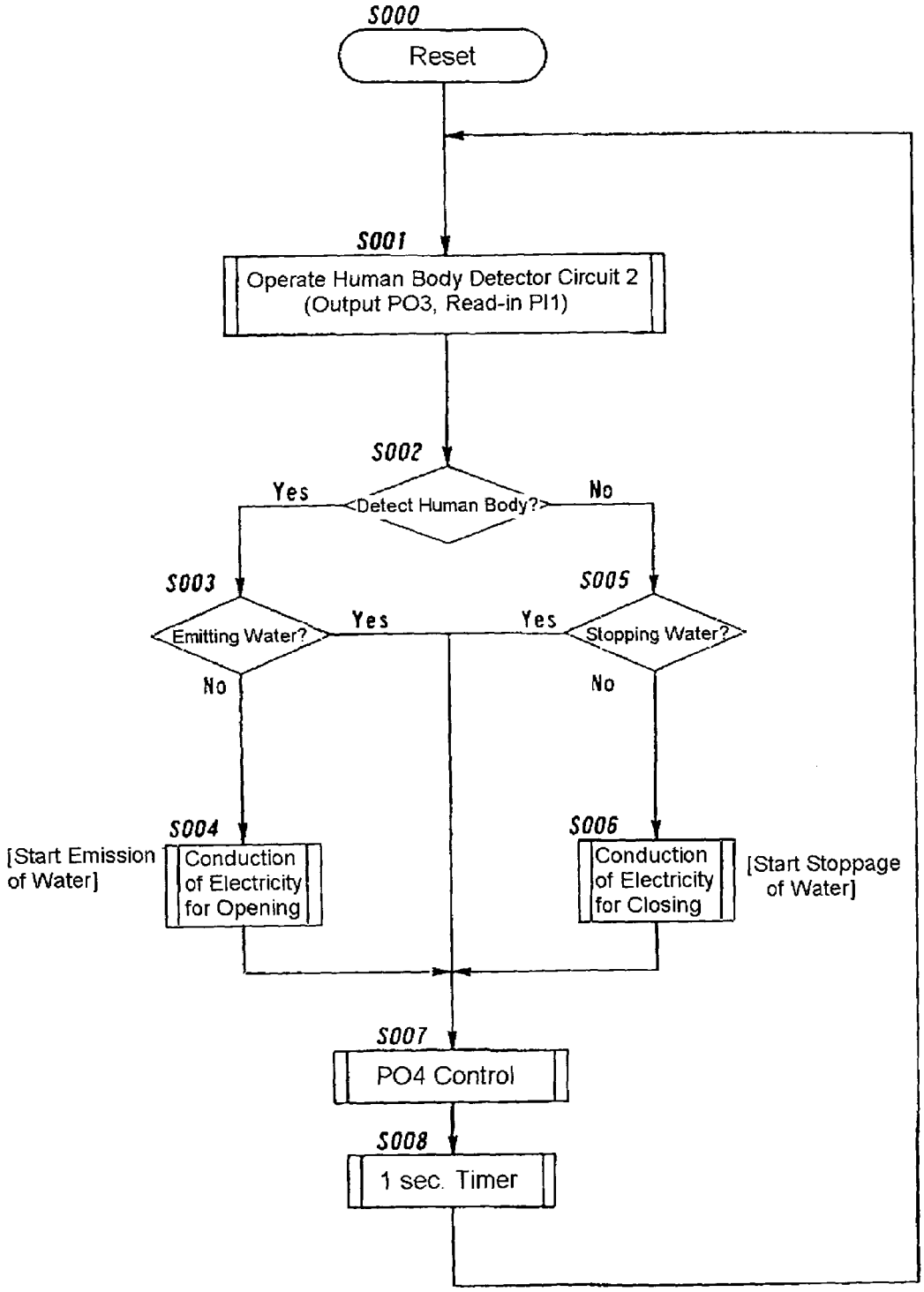
FIG. 2 is a flow chart showing a main routine of the first through third embodiments according to the present invention.

FIG. 2 is a flow chart of a main routine in the faucet apparatus.

This routine periodically operates the human body detector circuit 2, so as to drive the solenoid 3 for emission of water when detecting the human body. It is a well-known operation for an automatic hand wash-basin.

Operating the human body detector circuit 2 in a program step S001 of the main routine (hereinafter, S001) in FIG. 2, it then proceeds to steps S003 and S004 of conducting electricity for opening the electromagnetic valve in a case of detecting the human body, and to steps S005 and S006 of conducting electricity for closing the electromagnetic valve in a case of not detecting the human body.

Next, in a step S007, a PO4 control sub-routine of the μ-computer 1, which is charge control for the capacitor 5, is carried out. After waiting for one (1) second in the next step S008, it returns to S001, so as to form a loop.

Figure 3:
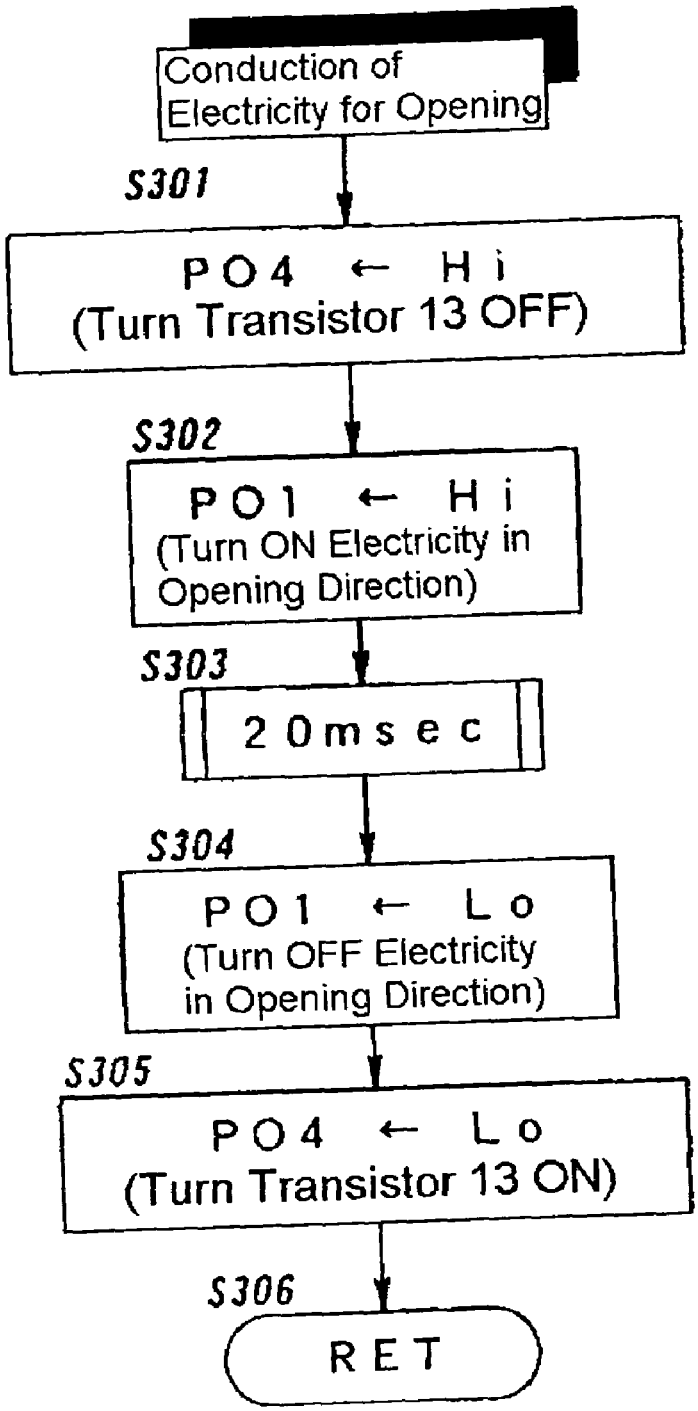
FIG. 3 is a flow chart showing steps for conduction of electricity for opening according to each of the first, second, third and fifth embodiments according to the present invention.
Figure 4:
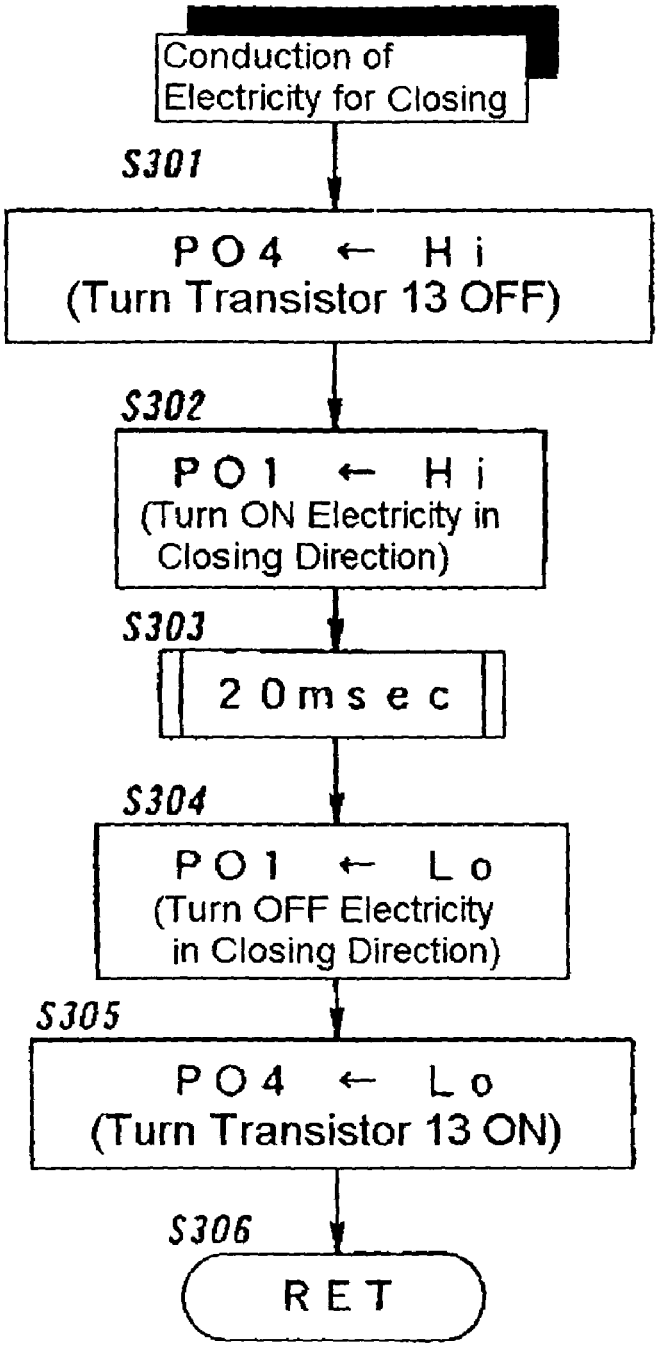
FIG. 4 is a flow chart showing steps for conduction of electricity for closing according to each of the first, second, third and fifth embodiments according to the present invention.

Flow charts of sub-routines for conduction of electricity for opening in S004 and for closing in S006 are shown in FIGS. 3 and 4, respectively. A flow chart in the PO4 control sub-routine in S007 is shown in FIG. 5.

In FIG. 3, the PO4 is made Hi in a step S301, thereby turning the transistor 13 OFF to stop the supply of electricity from the primary battery 10. In a step S302, the PO1 is made Hi, so as to conduct electricity into the solenoid 3 in an opening direction. After waiting for twenty (20) msec. in a step S303, the PO1 is made Lo in a step 304, so as to complete the conduction of electricity. The PO4 is made Lo again in a step S305 and then it returns to the main routine.

In FIG. 4, the port for controlling the conduction of electricity into the solenoid is changed from the PO1 to the PO2, compared to the flow chart shown in FIG. 3.

Figure 5:
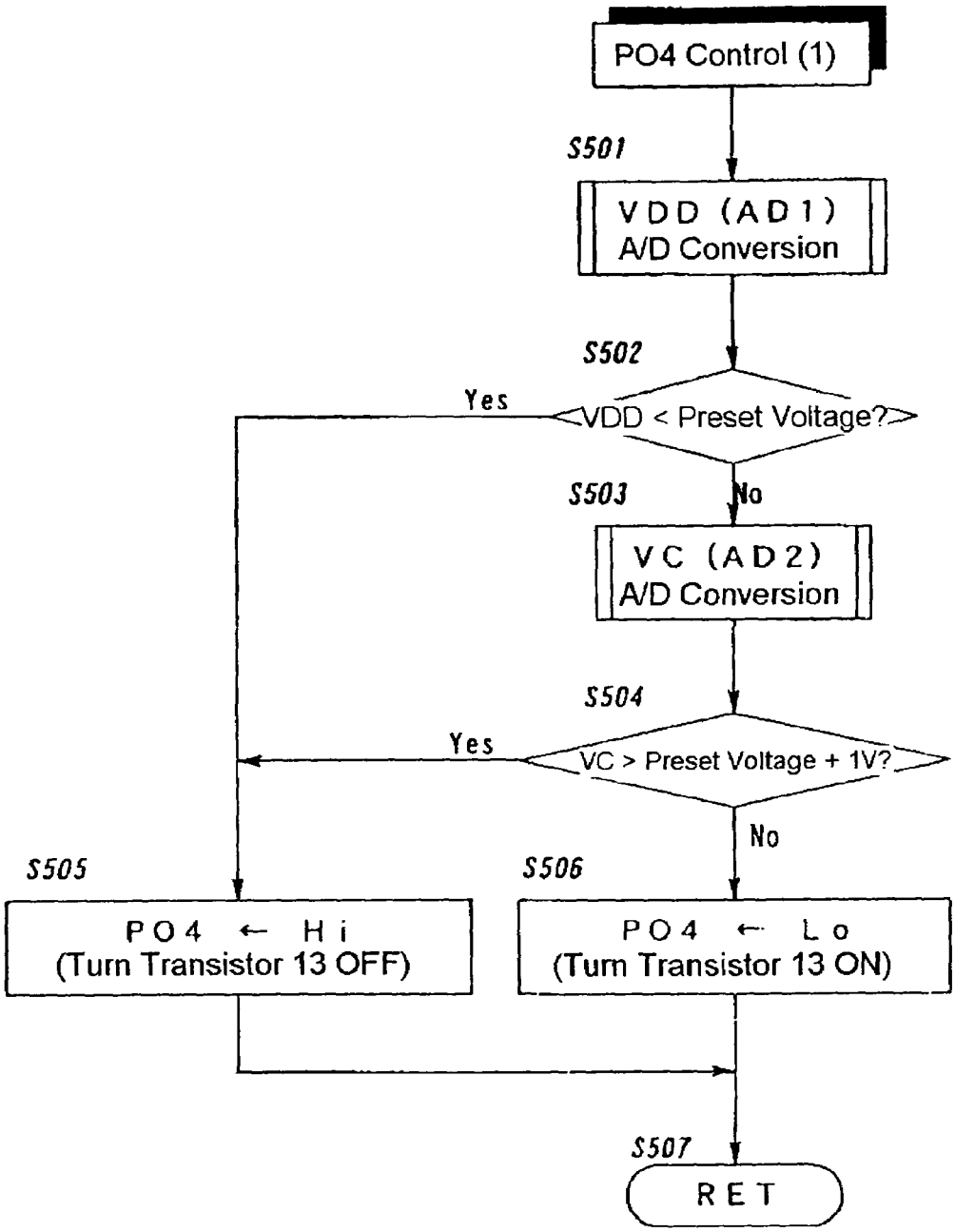
FIG. 5 is a flow chart showing steps for charge control in the first embodiment according to the present invention.

In FIG. 5, in a step S501, the VDD which is the output voltage of the voltage converter circuit 6 and also the power supply voltage of the faucet controller circuit is A/D converted. In a step S502, it is decided whether the VDD is at the preset voltage of the voltage converter circuit 6 or not (i.e., the constant voltage value enabling stabilized output), that is, whether the output of the voltage converter circuit 6 drops or does not drop from the original preset value due to instantaneous increase of load current and so on. This is because each of the circuit elements used in the voltage converter circuit 6, such as a transistor and a three (3) terminal regulator, etc., has a limit in the capacity thereof and changes inevitably occur in the output voltage due to load current.

When the load current of the faucet controller circuit rises abruptly, the VDD does not reach the preset voltage. In this instance, the PO4 is made Hi in a step S505, so as to turn the transistor 13 OFF, thereby preventing the power supply from the primary battery 10 to the faucet controller circuit, in particular to the solenoid conduction circuit 4.

In a case where the VDD is at the preset voltage in the step S502, the voltage VC of the capacitor 5 is A/D converted in a step S503. In a step S504, it is decided whether the VC is or is not sufficiently high, that is, whether the VC is higher than "the value obtained by adding 1V (for the voltage drop in the voltage converter circuit 6) to the preset value of the VDD". In a case where the VC is high, since there is no necessity of charging the capacitor 5, the transistor 13 is turned OFF in a step S505. In a case where the VC is low, the transistor 13 is turned ON in a step S506. The flow returns to the main routine from a step S507.

Figure 6:
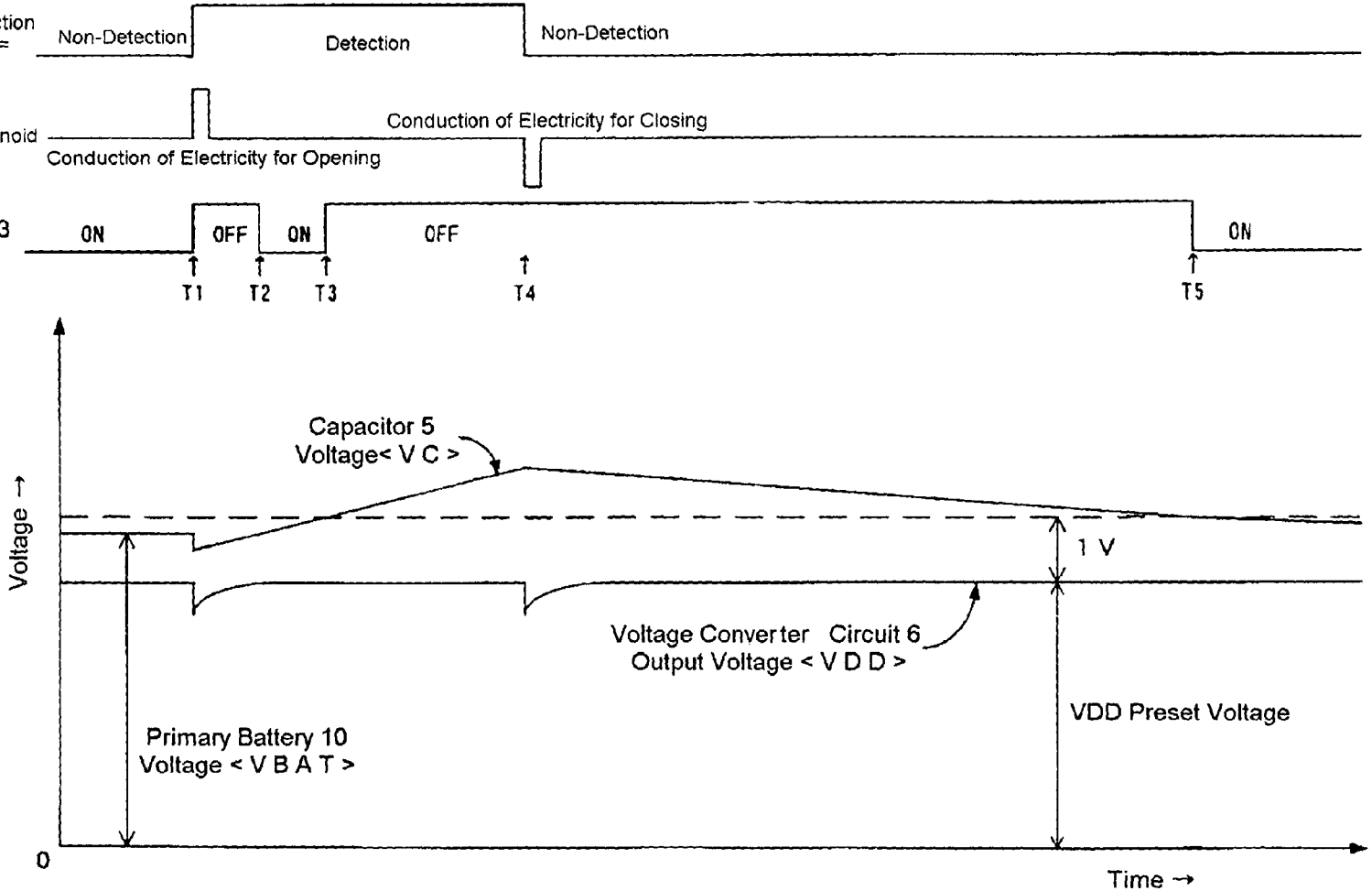
FIG. 6 is a timing chart showing the operation of the first embodiment according to the present invention.

FIG. 6 is a timing chart showing an example of the operation in the first embodiment. Before a time T1 (hereinafter, T1), the transistor 13 is turned ON because the VC is low, having a value almost equal to the output voltage of the primary battery 10. At the T1, when the human body is detected, the conduction of electricity to the solenoid 3 for opening the valve is carried out. At the time of this conduction, a large amount of current flows through the solenoid 3 even for a very short time period. However, the transistor 13 is turned OFF by the function of the flow chart shown in FIG. 3, no discharge occurs in the primary battery 10.

Further, since the VDD is decreased due to an abrupt increase of the load current, even after the conduction of electricity for opening is completed, the transistor 13 is turned OFF by the decision in the step S502 shown in FIG. 5, thereby preventing the current supply from the primary battery 10. When the emission of water is started, the power generator 7 starts to generate electric power, so that the VC rises. Since the VDD returns to the preset value, the transistor 13 is turned ON once at T2. However, at T3, since the VC exceeds (the preset voltage of VDD+1V), it is turned OFF. In this instance, since the faucet controller circuit is in a condition to be operable with the capacitor 5, the primary battery 10 is completely prevented from being discharged.

When no detection is made of the human body at T4, the conduction of electricity for closing is carried out. However, even in this instance, no electricity is supplied from the primary battery 10. When the emission of water is completed, the VC is gradually decreased due to slight consumption in the μ-computer 1, the human body detector circuit 2 and so on, leakage current of the capacitor 5 and so on. The μ-computer 1 detects such a decrease of the VC, the transistor 13 is turned ON, and the voltage of the capacitor 5 is maintained by means of the primary battery 10. Because the current is very weak, no significant effect occurs due to the resistor 11.

In this manner, since the transistor 13 is turned OFF every time a large amount of current load occurs, there is no possibility that the primary battery 10 will discharge a large amount of current. Also, the resistor 11, provided in the charging circuit for the capacitor 5, restricts output current of the primary battery 10 to a certain extent even in a case where the transistor 13 is turned ON. Specifically, even in cases of erroneous functioning of components such as an instantaneous delay in control of the transistor 13, it is possible for the resistor 11 to relax the discharge of a large amount of current from the primary battery 10.

Also, the voltage across the capacitor 5 is kept to be almost equal to that of the primary battery 10 at least. When power generation occurs, it quickly rises, distinct from a case of a storage battery. Specifically, when power generation starts, the consumption of the primary battery is immediately stopped. In the case of the storage battery in the conventional art, it is impossible to increase battery voltage at the same time of starting power generation, and also to stop the consumption of the primary battery at the same time of starting power generation.

The following effects are obtained from the above-mentioned operations in the present embodiment:

(1) Because the primary battery is not required to supply a large amount of current therefrom, even a battery of a type having no capacity for supplying a large amount of current can be applied. Specifically, a primary battery having a service-life of about 10 years can be applied, such as that developed for use in a gas meter.

(2) Because the consumption of the primary battery is immediately stopped when power generation is started, the maximum consumption amount of the primary battery can be expected correctly as "the consumption amount for a period of time when no power generation is performed". Therefore, it is possible to calculate the shortest service-life of the primary battery from the total capacity thereof, and to guarantee the service-life thereof by selecting a primary battery having the necessary capacity.

(3) There is substantially no restriction in the number of charge and discharge with regard to the capacitor, distinct from the storage battery. In a case of using a capacitor having a large capacity of around 1F, it is enough to conduct charge and discharge only once a day. Even assuming that the service-life is ten (10) years long, the number of charge and discharge is approximately 3,650 times. Such a service-life has no problem as a service-life of components of a capacitor. Therefore, unlike the conventional storage battery, there is no requirement for exchanging within several years.

(4) Since it is possible to conduct charge of the capacitor by simply applying voltage thereto, no such charge control is needed as in the case of the storage battery. As shown in FIG. 1, it is enough to restrict an output of the power generation to be equal or less than durable voltage of the capacitor 5. There is no likelihood of deterioration of the capacitor due to overcharge as is found in the conventional storage battery.

(5) Since the charge is stopped when the voltage across the capacitor 5 exceeds (the preset voltage of VDD+1V), there is no problem with regard to the charge of the capacitor even in a case of using a battery having high voltage as the primary battery 10.

(6) The voltage across the capacitor 5 is varied depending on charge/discharge thereof. However, since there is provided the voltage converter circuit 6, the increase of the voltage across the capacitor 5 has no influence on the operation of the faucet controller circuit.

As is mentioned in the above, components having an inherently long service-life are used in the capacitor and the primary battery, and there is no likelihood of deterioration of the components caused by the operating condition. In addition, the primary battery is not consumed other than as needed. As a result, the service-life of the primary battery can be guaranteed, so as to realize a faucet apparatus which is totally maintenance-free without any necessity for exchanging the components and the battery thereof.

The charging circuit for the capacitor 5 is constructed with a series circuit of the resistor 11 and the transistor 13. However, the resistor 11 is unessential in a case where ON resistance of the transistor 11 is appropriately adjusted. The resistor 11 can be eliminated by the way of, for example, selecting a transistor having large ON resistance as the transistor 13, adjusting gate signal voltage, and performing chopper control of the gate signal. Also, a Zener diode 9 is used as a means for restricting the output voltage of power generation. However, a resistor or a constant voltage IC may be applied instead.

Embodiment 2

Next, a second embodiment will be explained. This embodiment is different from the first embodiment in the flowchart of the PO4 control. This will be shown with reference to FIG. 7.

Figure 7:
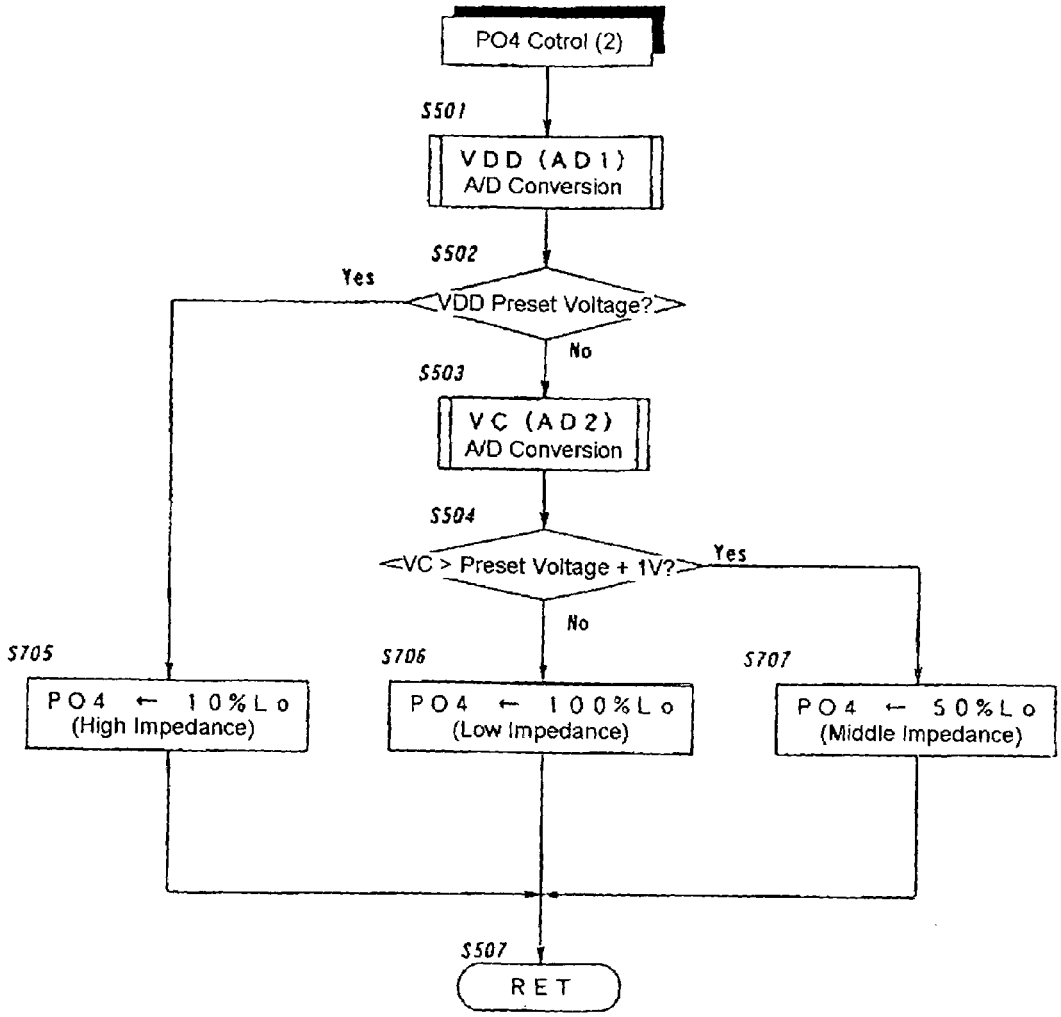
FIG. 7 is a flow chart showing steps for charge control in the second embodiment according to the present invention.

In FIG. 7, the same step number is used for the step having the same functions as shown in FIG. 5. When the VDD does not reach the preset voltage in S502, chopper control is performed on the PO4 to lower to Lo at 10% duty in S705. In S705, since the rate of time when the transistor 13 is turned ON is small, the impedance of the transistor 13 is high. Therefore, a large amount of current never flows from the primary battery 10. However, charge current flows in a case where the VC falls extremely.

When the VDD is at the preset value, the flow advances to S504, and when the VC is higher than (the preset voltage of VDD+1V), chopper control is performed on the PO4 to lower to Lo at 50% duty in S707, and thereby making the impedance a middle degree. There is no need of charge because the VC is high. However, if the VC drops abruptly, to which the PO4 control cannot respond quickly, it is possible to conduct charge to a certain extent.

If the VC is equal to or less than (the preset voltage of VDD+1V) in S504, the transistor 13 is turned completely ON in S706, and thereby making the impedance low. The time constant for charging is small, and the charge is conducted even in case of a small voltage difference.

In this manner, not bringing the connection of the primary battery 10 and the capacitor 5 into simple ON/OFF control, but into a method in which the impedance (i.e., ON resistance) can be controlled, it is therefore possible to optionally control the time constant of the charging circuit for the capacitor 5. With this, it is possible to make the time for charging the capacitor the shortest within such a range of current that no deterioration is caused to the primary battery.

For example, normally, the impedance is kept to be low, so as to enable a good response of charge. If the load current of the circuit rises, no charge is needed because of the high voltage across the capacitor and so on, the impedance is made high, so as to restrict the charge current therethrough. In the case of the conventional art, since there is determined an appropriate range of the charge current of the storage battery, it is impossible to control the charge current from the primary battery within a wide range in this manner.

As a method for adjusting the impedance of the charge controller means, various types can be used. For example, the method by changing the ON duty of the transistor as shown in the FIG. 7, a method by combining the resistor and the transistor in series or in parallel, and so on may be used.

Embodiment 3

Next, a third embodiment will be explained. This embodiment is different from the first embodiment in the flow chart of the PO4 control. This will be explained with reference to FIG. 8.

Figure 8:
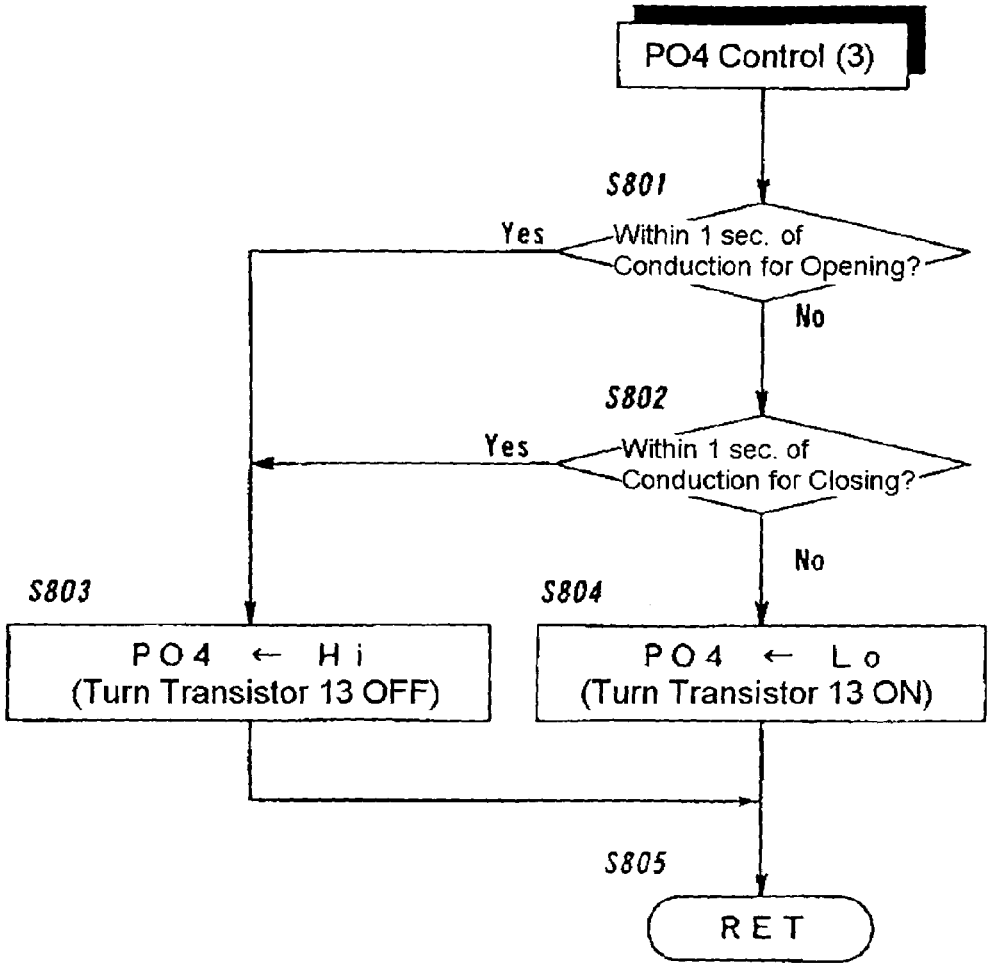
FIG. 8 is a flow chart showing steps for charge control in the third and fifth embodiments according to the present invention.

In FIG. 8, it is decided whether it is within one (1) second from the conduction of electricity to the solenoid 3 for opening in S801. The period of within one (1) second from the conduction of electricity for opening means, for the faucet controller circuit, the time just after the period when large load current flows through. Therefore, it is expected that the VDD is temporarily decreased at this time. In such a case, since there is a possibility that current is supplied from the primary battery 10, the transistor 13 is turned OFF in S803. In the same manner, if it is within one (1) second from the conduction of electricity for closing in S802, the transistor 13 is turned OFF in S803. Other than these, the transistor 13 is turned ON in S804.

With the third embodiment, the charge of the capacitor 5 can be controlled only by a timer in the μ-computer 1, and A/D conversion is not necessary. Therefore, the control can be performed with ease. It is also possible to operate in combination with each voltage condition of the first embodiment. In addition, it is possible to use a method in which the impedance is increased for one (1) second from the conduction of electricity into the solenoid 3 by combining the chopper control of the transistor 13 shown in the second embodiment. Alternatively, a method in which the ON duty of the transistor 13 is gradually increased depending on a lapse of time from the conduction of electricity into the solenoid may be used.

Embodiment 4

Figure 9:
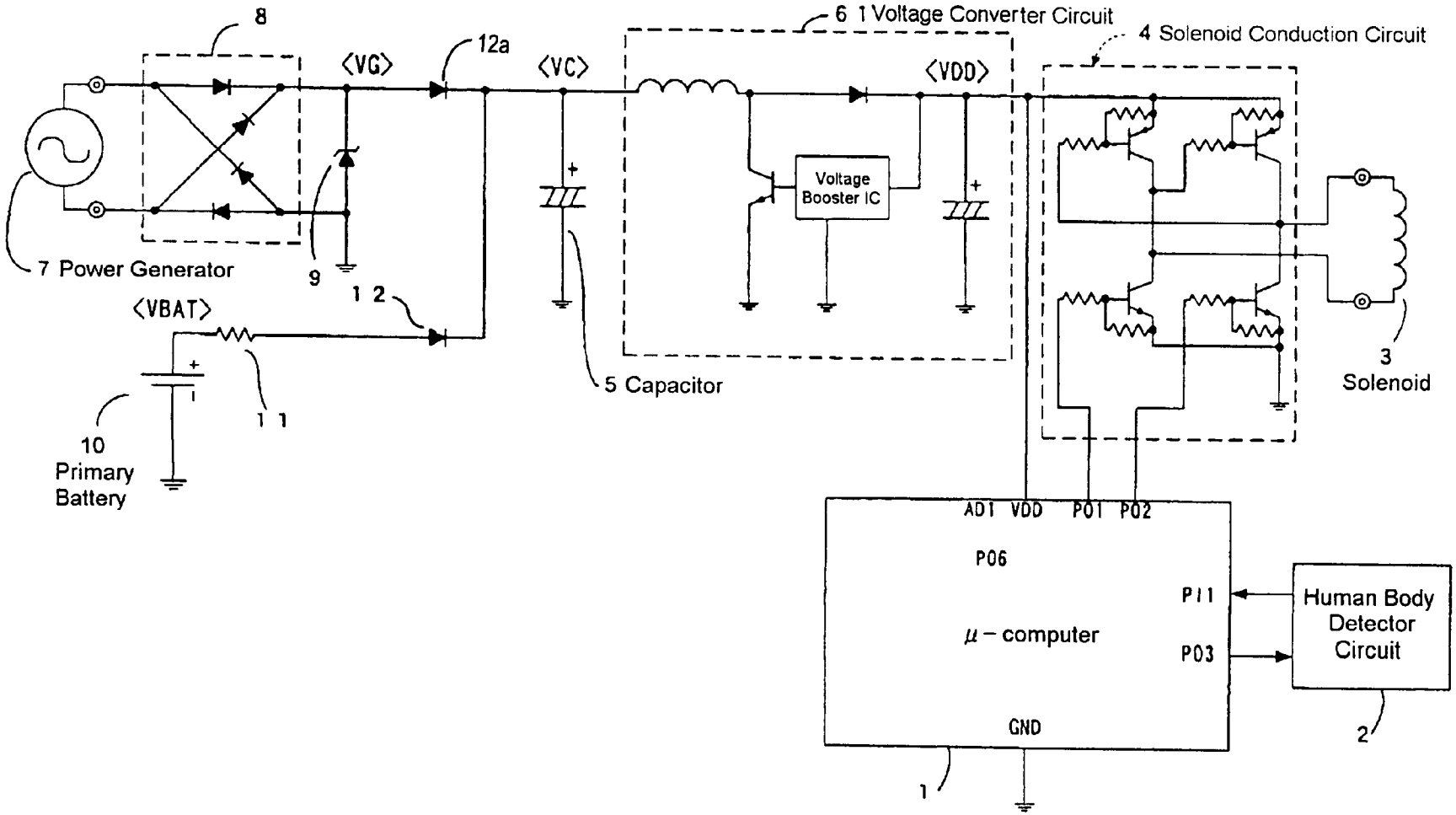
FIG. 9 is a circuit diagram of a fourth embodiment according to the present invention.

FIG. 9 shows the circuit diagram of a fourth embodiment. This is different from FIG. 1 in the structure of the voltage converter circuit, and in respects that no transistor 13, PO4 for controlling thereof, nor A/D converter terminal of the VC is provided. The operation flow chart is the same as that of the first embodiment but removing the PO4 control therefrom.

A voltage converter circuit 61 in FIG. 9 is a switching type voltage booster circuit. By using such a voltage booster IC for the exclusive use of automatically controlling ON/OFF of switching to make output voltage constant, it is possible to easily obtain a circuit having low energy consumption and high accuracy.

Figure 10:
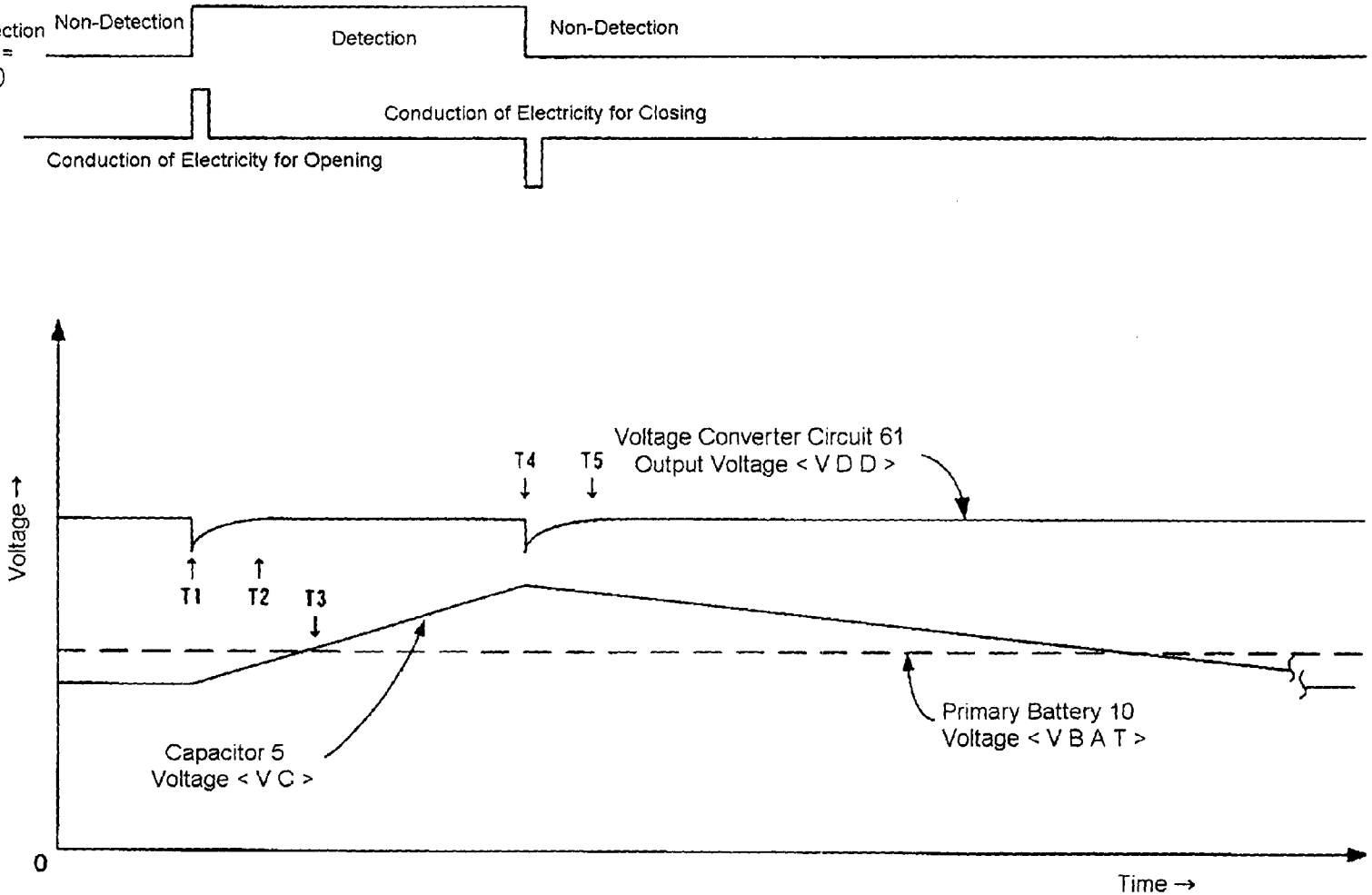
FIG. 10 is a timing chart showing the operation of the fourth embodiment according to the present invention.

FIG. 10 is a timing chart of an operation example thereof. When the human body is detected at T1, the conduction of electricity into the solenoid for opening is carried out. At this time, the output voltage VDD of the voltage converter circuit 61 lessens due to the conduction of electricity for opening. When the VDD lessens, the voltage converter circuit 61 starts the switching operation with the voltage booster IC, and the VDD rises.

During this operation, as the power supply for the switching operation, the electric charge in the capacitor 5 is consumed. However, there is no consumption in the primary battery 10. The switching type voltage booster circuit requires large pulse current instantaneously. The resistor 11 restricts the output current of the primary battery 10. The power supply for the switching operation is only the capacitor 5 having low output impedance. The primary battery 10 makes little contribution and is not consumed.

If the VDD lessens after T5, the voltage converter circuit 61 performs the switching operation intermittently for a short time period, whereby it maintains the VDD at the preset value. In this instance, the power supply is only the capacitor 5, too.

The present embodiment achieves the following effects:

(1) Since the load is of a switching type, it is possible to control the consumption of the primary battery only by means of the resistor 11. Therefore, the charge controller circuit and the control method thereof are simple.

(2) Because the voltage converter circuit is of a switching type, the conversion from the VC to the VDD is superior in the efficiency thereof. The voltage converter circuit 6 shown in FIG. 1 is low in price due to the simple construction thereof, but the drop in voltage causes loss. With the circuit of a switching type shown in FIG. 9, it is possible to maintain almost constant efficiency in spite of the voltage. Also, it is possible to obtain the same effects not only with a circuit of a voltage booster type, but also with a voltage drop type.

(3) By boosting the voltage, it is possible to widen the voltage range of the capacitor5 as the power supply. For example, such a condition that the primary battery 10 is 1.5V, the minimum voltage of the capacitor 5 is 1.0V, and the VDD is 5.0V is sufficient. The wider the usable voltage range of the capacitor 5, the less the charge from the primary battery 10.

(4) Since the voltage converter circuit 61 is of a voltage booster type, the VDD may be lower than the VC, and a primary battery 10 having low voltage may be used. Thus, it is possible to decrease the number of cells of the primary battery 10, or to apply a capacitor having low durable voltage as the capacitor 5, which contributes to miniaturization and/or price reduction of the faucet apparatus.

Embodiment 5

Figure 11:
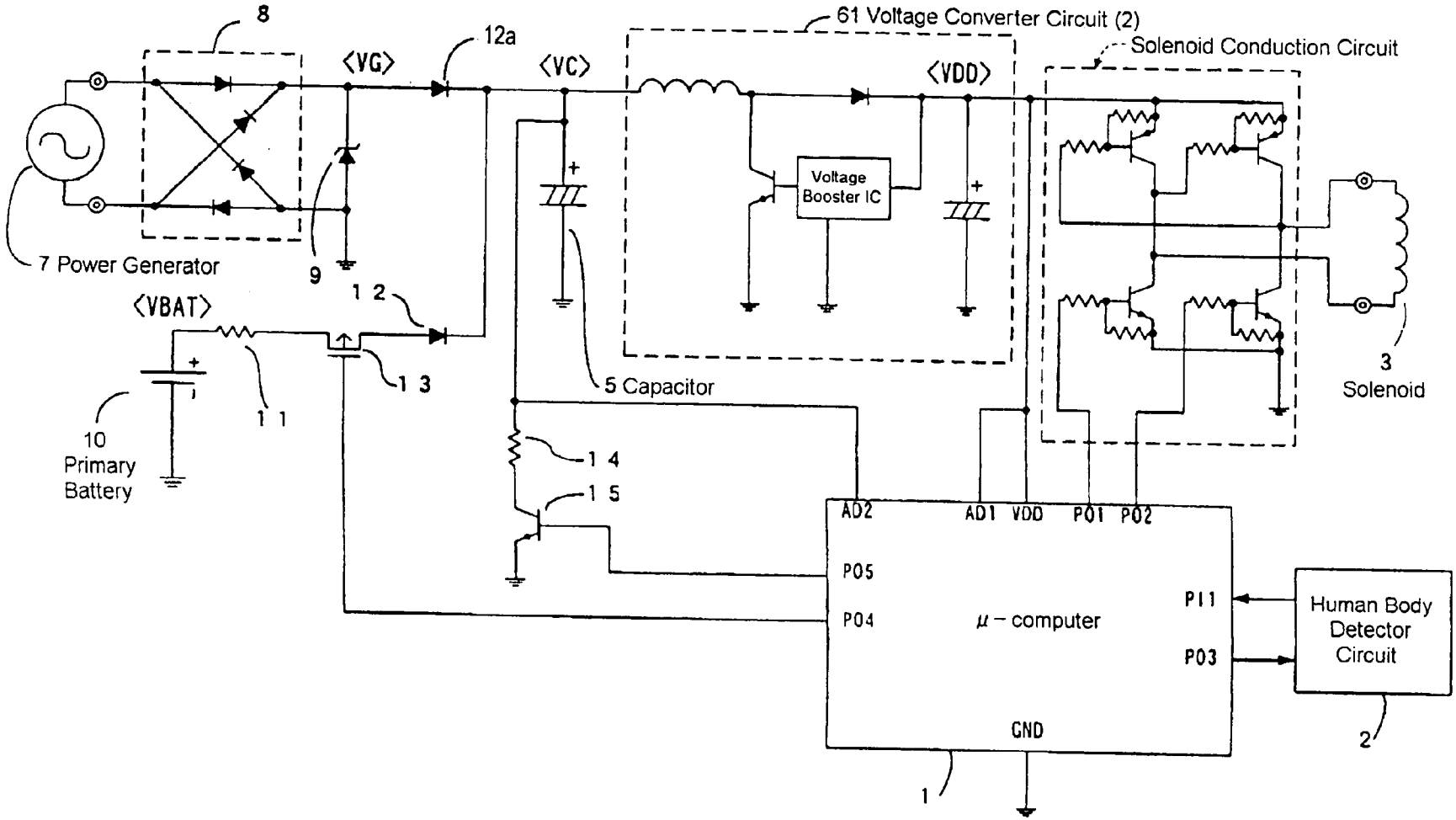
FIG. 11 is a circuit diagram of the fifth embodiment according to the present invention.

FIG. 11 is the circuit diagram of a fifth embodiment. In FIG. 11, compared to FIG. 9, there is further provided a transistor 13 which is controlled by a port PO4. Furthermore, a resistor 14 and a transistor 15 construct a discharge circuit of the capacitor 5, which is controlled through a port PO5 of the μ-computer 1. Also, the voltage VC of the capacitor 5 is inputted to AD2, i.e., an A/D conversion input port of the μ-computer 1.

Figure 12:
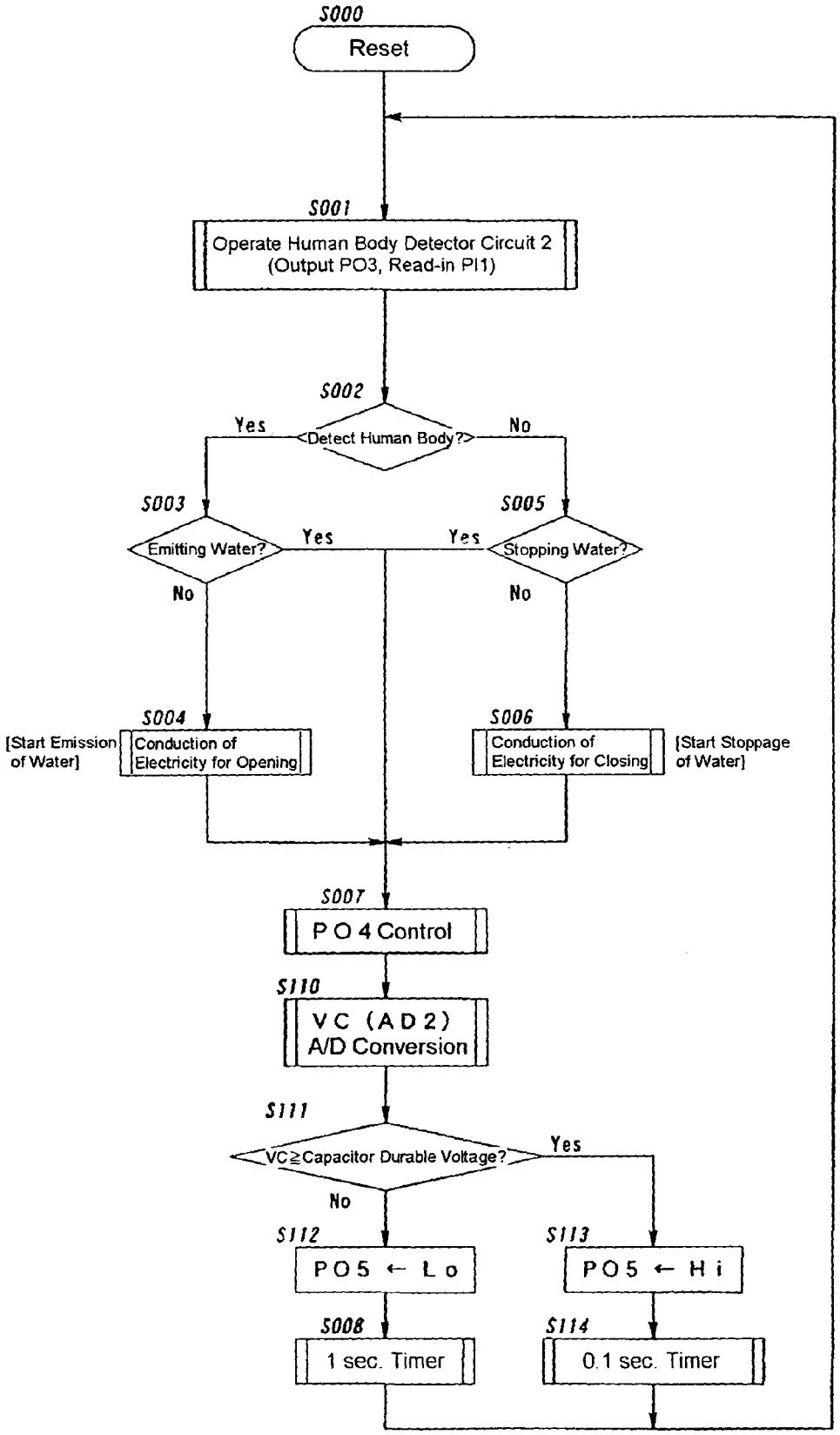
FIG. 12 is a flow chart showing steps of a main routine of the fifth embodiment according to the present invention.

A main flow chart of the fifth embodiment is shown in FIG. 12. The flow charts for the conduction of electricity for opening and for closing are the same as those shown in FIGS. 3 and 4, respectively. The flow chart for the PO4 control is the same as that shown in FIG. 8. First, explanation will be given on the flow chart shown in FIG. 12.

In FIG. 12, the same step number is used for the same step as that shown in FIG. 2. After S007 in FIG. 12, the voltage VC of the capacitor 5 is A/D converted. In S111, it is decided whether or not the VC is equal to or greater than the durable voltage, i.e., the voltage which can be applied as a component. If the VC is less than the durable voltage, the PO5 is made Lo in S112, so that the transistor 15 is turned OFF. The flow proceeds to S008. The subsequent steps are the same as those shown in FIG. 2.

If the VC is equal to or greater than the durable voltage of the capacitor 5 in S111, the PO5 is made Hi, so that the transistor 15 is turned ON in S113. The discharge of the capacitor 5 is conducted through the resistor 14. Further, after waiting for a very short period of time, such as 0.1 sec., in S114, the flow returns to S001.

Also, the control of the PO4 shown in FIG. 8 is the same as is explained in the third embodiment. The transistor 13 is turned OFF for one (1) second after the conduction of electricity to the solenoid 3 under a condition that the load is the greatest for the voltage converter circuit 61.

The present embodiment achieves the following effects:

(1) The voltage across the capacitor 5 is restricted by using a Zener diode 9. However such an element has a limitation from a view point of electric power. Otherwise, a constant voltage output circuit may be used, such as a three-terminal regulator or the like. However, if the output voltage of the electric power generation means becomes too high, there is a possibility that it exceeds the durable voltage of the components of the voltage restriction means. The electric power generation means, not limited to the hydroelectric power generation, has a tendency of decreasing the output voltage thereof in a case where the output current is large. If the discharge of the capacitor 5 is conducted through the resistor 14 and the transistor 15, the effect of suppressing the output voltage of the electric power generation means is achieved. As a result, it is possible to protect the components which are directly connected to the electric power generation means from damage caused by applying high voltage thereto.

(2) Making the timer short to 0.1 sec. in S114 of FIG. 12 increases the speed of looping the main routine shown in FIG. 12. Consumption within the μ-computer 1 including the human body detector circuit in S001, the A/D conversion and so on is increased, and the effect of promoting the discharge of the capacitor 5 is achieved. In a case where the capacity of the electric power generation means is relatively small, the capacitor 5 can be protected from voltage increase simply by means of a change in operation of the μ-computer 1, such as increasing the number of the operation of the circuit portions which brings about higher consumption therein.

(3) The VDD lessens just after the conduction of electricity to the solenoid 3, but the voltage converter circuit 61 performs a switching operation with continuity. In this instance, if the primary battery 10 is consumed even partially, it is impossible to obtain an accurate calculation of the consumption in the primary battery 10. In particular, since the resistor 11 determines the time constant for the charge of the capacitor 5, it is impossible to make the resistor 11 have high resistance unconditionally. However, in the present embodiment, since the transistor 13 breaks the load current when it is at a maximum range, the value of the resistor 11 can be determined as the time constant for the charge of the capacitor 5 under the worst condition.

The PO4 control may be performed in such a manner as shown in FIGS. 5 and 7. Also, if a switching waveform for the voltage converter circuit 61 is inputted to a port of the μ-computer 1, it is possible to directly determine whether the switching operation is performed or not. Therefore, it is possible for the μ-computer 1 to turn the transistor 13 OFF or to make the transistor 13 have high impedance by detecting the switching operation itself.

By using a voltage booster IC which can set the ON/OFF of the switching operation with an external signal, it is also possible to bring the switching operation and the ON/OFF control of the transistor 13 into synchronization with the μ-computer 1.

Embodiment 6

Figure 13:
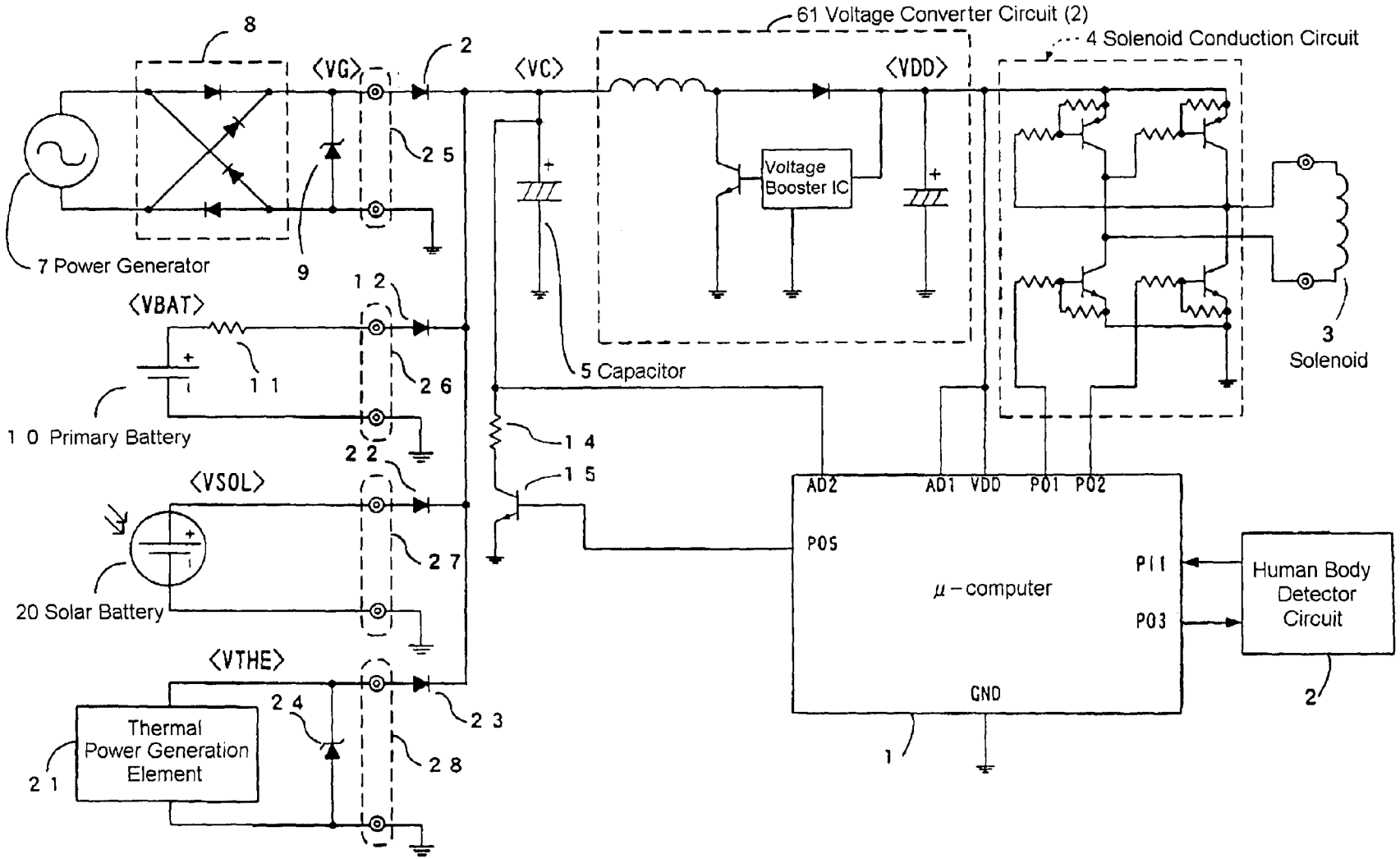
FIG. 13 is a circuit diagram of a sixth embodiment according to the present invention.

FIG. 13 shows a sixth embodiment. In FIG. 13, compared to FIG. 11, the transistor 13 is deleted, but a solar battery 20 and a thermal power generation element 21 are added.

The solar battery 20 is positioned at a location having good illumination conditions, such as an upper portion of the faucet apparatus, and the charge of the capacitor 5 is conducted through a diode 22. The solar battery, having a limitation on the maximum output voltage therefrom, cannot conduct electric power generation high enough that it may damage general electric components. Therefore, a case may be considered where no circuit is needed for restricting the output voltage as far as a charger means for the capacitor 5 is provided.

Reference number 21 indicates a thermal power generation element, which has a sufficient capacity of generating electric power in a case where it is attached to a pipe of the faucet apparatus for hot water and cold water. Restricting the maximum output voltage by a Zener diode 24, the charge of the capacitor 5 is conducted through the diode 23.

Reference numbers 25 through 28 indicate connectors which can be attached and detached. Such a connectors are provided for connecting the electric power generation means such as the power generator 7, the solar battery 20 and the thermal power generation element 21, and the primary battery 10, to the capacitor 5.

Explanation will be given on functions of each component shown in FIG. 13. The operation of the discharge circuit, which is constructed with the resistor 14 and the transistor 15, is already explained in the fifth embodiment. However, if plural electric power generation means are connected in the manner shown in FIG. 13, the effect of the discharge circuit is increased. With the discharge circuit, the capacitor 5 is always subjected to an appropriate load, so that it is possible to suppress the voltage across the capacitor 5 and the output voltages of all electric power generation means. Basically, it is necessary to manage so that the maximum output voltage of each electric power generation means is equal to or less than a predetermined voltage. However, with the discharge circuit for the capacitor 5, the safety can be increased.

In the structure shown in FIG. 13, the electric power generation means such as the power generator 7, the solar battery 20 and the thermal power generation element 21, each being different from one another, are used simultaneously. Since those electric power generation means have their own power generation characteristics, each being totally different from one another, it is impossible to control the charge to be under optional conditions.

However, according to the present invention, since the capacitor 5 is used as a charge means, there is no threat of deterioration in performance even due to charging with a large amount of current such as in a case of hydroelectric power generation or the like, and it is still possible to charge with a very small amount of current such as in a case of a solar battery or the like. The range in response to voltage is also wide, and there is no problem even if various electric power generation means are combined.

In a case where a storage battery is used as in the conventional art, since the charging condition recommended for a storage battery cannot be satisfied, the case is expected where not only the storage battery is deteriorated, but also even the charge is not conducted satisfactorily. Therefore, it is impossible to combine the power generation means, each being different from one another, in the case of the storage battery according to the conventional art.

Further, in FIG. 13, all circuits provided on the side of the capacitor 5 from the portion of the connectors 25 through 28 have the same structure. Since the capacitor 5 can respond to various charging conditions, it is possible to freely connect, remove and/or replace by arranging the polarity of the electric power generation means or the primary battery appropriately.

It is possible to combine the hydroelectric power generation and the solar battery depending on the environment and/or frequency of using the faucet apparatus. In addition, it is possible to change the specifications, such as using only the hydroelectric power generation but in plural numbers thereof, exchanging the electric power generation means, replacing the primary battery with one having different voltage, using plural numbers of the primary batteries so as to increase a back-up capacity thereof, at any time including the periods after setting-up and during the use of the apparatus. Originally, the use of the primary battery in a case where the electric power generation amount is short results from the fact that the electric power generation capacity and the frequency of use cannot be known. Therefore, it is very advantageous that the electric power generation means can be changed depending on the situation.

Embodiment 7

Figure 14:
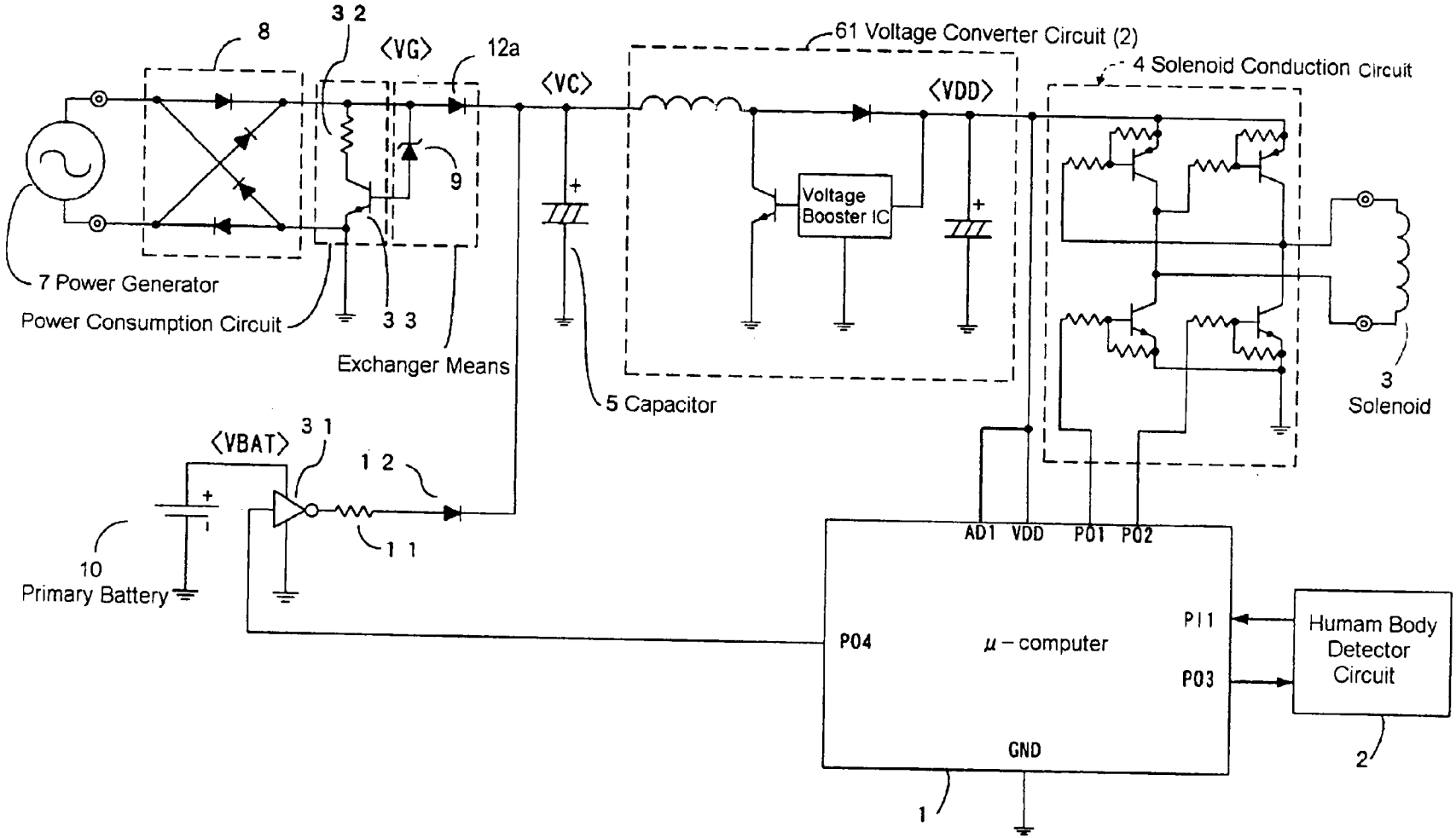
FIG. 14 is a circuit diagram of a seventh embodiment according to the present invention.

FIG. 14 shows a seventh embodiment. This is different from the fifth embodiment shown in FIG. 11 in the following respects:

Instead of the transistor 13 shown in FIG. 11, an inverter 31 is used. The inverter 31 has the same function as that of the transistor 13 shown in FIG. 11. However, the connection of an output of the primary battery 10 to a power supply terminal of the inverter 31 makes stress which is applied to the element when the battery is attached small compared to the case of the transistor 13. Therefore, it is easier to manage as the charge controller means for the capacitor 5.

In FIG. 14, there is provided no discharge circuit for the capacitor 5, which is constructed with the resistor 14 and the transistor 15 as shown in FIG. 11. Therefore, the voltage across the capacitor 5 is not inputted into the μ-computer 1.

Further, to an output of a full-wave rectifier 8 is connected an electric power consumption circuit which is comprised of a resistor 32, a transistor 33 and a Zener diode 9. From the viewpoint of the functions, this circuit is equal to the voltage restriction circuit of the Zener diode 9 shown in FIG. 11. However there is a difference in the active consumption of the output of the power generator 7.

The power consumption circuit in the seventh embodiment is for solving the problem that the flow rate within the faucet apparatus fluctuates due to the change in load current of the power generator.

Normally, the power generator 7 is in a condition of conducting the output of charge current for the capacitor 5. The flow rate of the faucet apparatus is set to an appropriate amount under this condition. However, if a condition that the capacitor 5 is fully charged and does not need the charge current, or that the charge should be inhibited, the output current of the power generator 7 loses a destination to flow to. For example, a case may be considered where the constant voltage IC is used as the output voltage restriction circuit for the electric power generation means.

The charge of the capacitor is stopped by any means, the output current of the power generator comes to be zero (0), the pressure loss in the hydroelectric generator portion is decreased, and the flow rate within the faucet apparatus is increased. In this manner, in the case of the hydroelectric power generation, the load current of the generator is changed depending on the charging condition of the electricity storage means, and the flow rate of the faucet apparatus fluctuates regardless of a user's intention.

In the seventh embodiment, the capacitor 5 is small in the input impedance during the charging operation. It is possible to consider the load to be almost constant volatgae. The output voltage of the full-wave rectifier 8 has a value obtained by adding the forward direction voltage of the diode 2 to the voltage across the capacitor 5, and therefore, the load current of the power generator is stabilized. When the charge of the capacitor 5 rises to desired voltage, the electric power consumption circuit of the Zener diode 9, the resistor 32 and the transistor 33 continuously performs the consumption of the output current from the power generator instead of the charging current for the capacitor 5.

Seen from the power generator, the capacitor 5 is a load if the voltage is equal to or less than that for turning the Zener diode 9 ON, and the resistor 32 is a load if the voltage is greater than that. The output current therefore flows at all times. Therefore, the torque continues to be generated within the power generator, and the flow rate of the faucet apparatus never fluctuates thereby.

The electric power consumption circuit has an effect of restricting the voltage across the capacitor 5, but also functions as the output voltage restriction circuit. By suppressing the output voltage, the reverse voltage applied to the diodes of the full-wave rectifier 8 is also restricted. Therefore, it is possible to use components having low durable voltage in the full-wave rectifier 8. In particular, since most Schottky diodes of a small loss have low durable voltage, it becomes possible to use such a diode, which contributes to the improvement of the apparatus efficiency.

Embodiment 8

Figure 15:
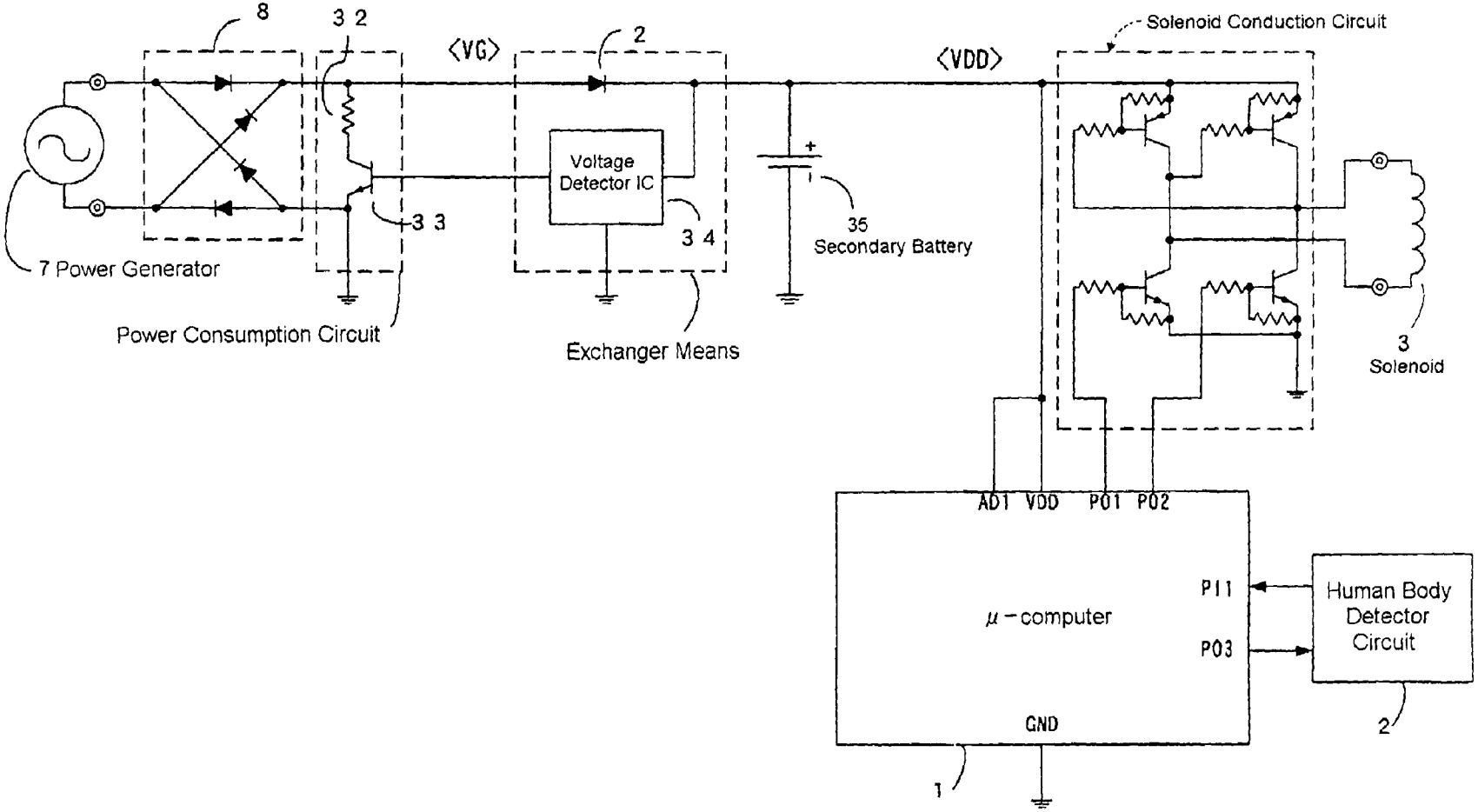
FIG. 15 is a circuit diagram of an eighth embodiment according to the present invention.

Also, the use of such an electric power consumption circuit should not be limited to the case using the capacitor as the electricity storage means as shown in FIG. 14, but also it is effective in all faucet apparatus in which the electricity storage is performed by hydroelectric power generation. An example is shown in FIG. 15, which uses a secondary battery as the electricity storage means.

Since the secondary battery is deteriorated if it is overcharged, the charge must be stopped in the moment of the full charge. The easiest method for charging is a method with constant voltage, and the structure shown in FIG. 15 may be used.

A voltage detector IC 34 detects the voltage indicative of the completion of charging for the secondary battery 35. When the secondary battery 35 is in a full-charge condition, the voltage detector IC 34 turns a transistor 33 ON and a resistor 32 is a load on the power generator 7. Making the impedance of the resistor 32 smaller than that of the secondary battery 35 lowers the output voltage of the full-wave rectifier 8, and the charge of the secondary battery 35 will halt thereby.

The resistor 32 is a load which substitutes for the secondary battery 35 and it draws current from the power generator 7 continuously. Therefore, the flow rate of the faucet apparatus will never be changed abruptly in the same manner of the seventh embodiment.

Embodiment 9

In FIG. 15, the charge condition of the secondary battery 35 is decided with the voltage detector IC so as to perform the exchange straightly depending on only the level of the voltage. It is however also possible to make the decision depending on the charging characteristics of the secondary battery 35 using the A/D conversion function of the μ-computer 1, so as to control the transistor 33 using a port the μ-computer 1. A circuit for this is shown in FIG. 16.

Figure 16:
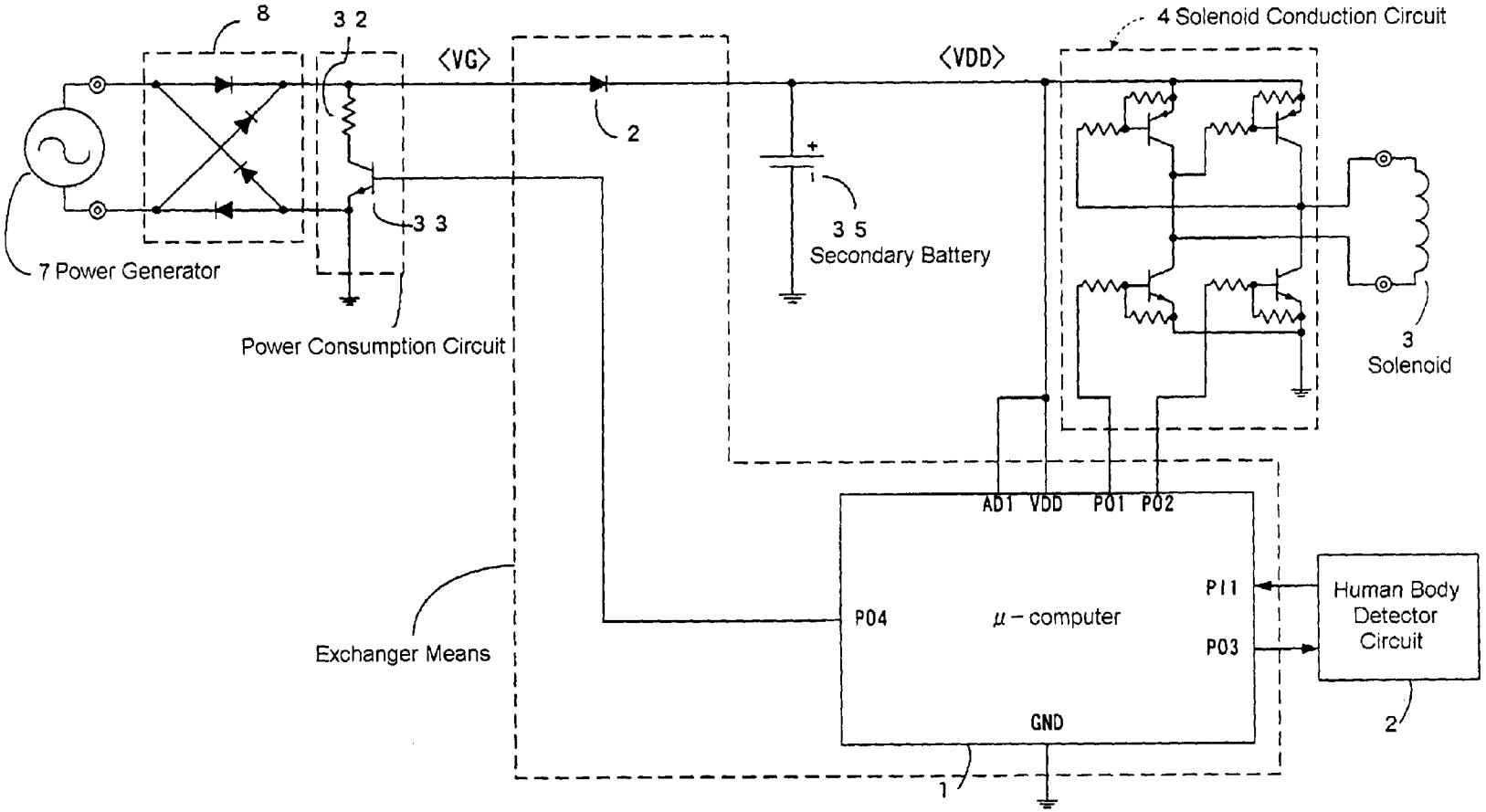
FIG. 16 is a circuit diagram of a ninth embodiment according to the present invention.

As shown in FIG. 16, it is possible to optionally select either of the secondary battery 35 or the resistor 32 as a load for the power generator 7 by means of the μ-computer 1. For example, with regard to a nickel-cadmium battery showing a memory effect in a case of repeating low charge/discharge, it is preferable to conduct charge after the conduction of high discharge. Even in such a case, it is possible to conduct or stop the charge for the secondary battery 35 at discretion depending on the program of the μ-computer 1 without any fluctuation of the flow rate of the faucet apparatus.

As is fully explained in the above, according to the structure of the present invention, it is possible to provide a controller apparatus for a faucet for controlling the faucet using energy by electric power generation, wherein all members used therein can maintain the necessary performances thereof for a long period of time. Therefore, no replacement nor exchange is needed for the components such as a battery or the like until the faucet apparatus reaches to the product service-life, and thereby realizing the true maintenance-free objective of the faucet apparatus.

Furthermore, with the provision of the electric power consumption circuit for continuously drawing the output current from the power generator, the flow rate never fluctuates depending on the charge condition of the electricity storage means.

What is claimed is:

1. A controller apparatus for a faucet, comprising:

a capacitor;

a voltage conversion means for converting a voltage across said capacitor to a predetermined voltage;

a faucet controller circuit being operated with supply of electricity from said voltage conversion means;

an electromagnetic valve for opening or closing a flow passage by said faucet controller circuit;

an electric power generation means for generating electric power;

a primary battery; and a charge controller means for controlling a charging process from said primary battery to said capacitor, wherein said capacitor is charged with either of an output of said electric power generation means and said primary battery.

2. A controller apparatus for a faucet, as defined in claim 1, wherein said charge controller means controls the charging process depending on the voltage across said capacitor.

3. A controller apparatus for a faucet, as defined in claim 1, wherein said charge controller means restricts a supply of electricity from said primary battery to said faucet controller circuit.

4. A controller apparatus for a faucet, as defined in claim 1, wherein said charge controller means is a switching means.

5. A controller apparatus for a faucet, as defined in claim 1, wherein said charge controller means is an impedance changing means.

6. A controller apparatus for a faucet, as defined in claim 4, wherein said switching means breaks a connection between said primary battery and said capacitor depending on a load current of said faucet controller circuit.

7. A controller apparatus for a faucet, as defined in claim 4, wherein said switching means breaks a connection between said primary battery and said capacitor when an output of said voltage conversion means decreases.

8. A controller apparatus for a faucet, as defined in claim 4, wherein said switching means breaks a connection between said primary battery and said capacitor for a predetermined time after conduction of electricity into said electromagnetic valve.

9. A controller apparatus for a faucet, as defined in claim 5, wherein said impedance changing means changes an impedance of a connection between said primary battery and said capacitor to a high impedance depending on a load current of said faucet controller means.

10. A controller apparatus for a faucet, as defined in claim 5, wherein said impedance changing means changes an impedance of a connection between said primary battery and said capacitor to a high impedance when an output of said voltage conversion means decreases.

11. A controller apparatus for a faucet, as defined in claim 5, wherein said impedance changing means changes an impedance of a connection between said primary battery and said capacitor into a high impedance for a predetermined time after conduction of electricity into said electromagnetic valve.

12. A controller apparatus for a faucet, as defined in claim 1, wherein said voltage conversion means is a switching type voltage conversion circuit.

13. A controller apparatus for a faucet, as defined in claim 1, wherein said charge controller means is a resistor.

14. A controller apparatus for a faucet, as defined in claim 4, wherein said voltage conversion means is a switching type voltage conversion circuit, and a connection between said primary battery and said capacitor is broken when said switching type voltage conversion circuit conducts a switching operation.

15. A controller apparatus for a faucet, as defined in claim 5, wherein said voltage conversion means is a switching type voltage conversion circuit, and an impedance of a connection between said primary battery and said capacitor is changed to a high impedance when said switching type voltage conversion circuit conducts a switching operation.

16. A controller apparatus for a faucet, as defined in claim 12, wherein said voltage conversion circuit is a voltage booster circuit.

17. A controller apparatus for a faucet, as defined in claim 5, wherein said impedance changing means is either of a series connection and a parallel connection of a resistor and a switching element.

18. A controller apparatus for a faucet, as defined in claim 5, wherein said impedance changing means conducts an ON/OFF control of a switching element.

19. A controller apparatus for a faucet, as defined in claim 1, further comprising a discharge means for discharging said capacitor when the voltage across said capacitor is equal to or greater than a predetermined voltage.

20. A controller apparatus for a faucet, as defined in claim 19, wherein said discharge means is constructed with a resistor and a switching element.

21. A controller apparatus for a faucet, as defined in claim 19, further comprising a human body detection means for detecting a user of the faucet, wherein a frequency of operations of said human body detection means is controlled depending on the voltage across said capacitor.

22. A controller apparatus for a faucet, as defined in claim 1, wherein said electric power generation means is a hydroelectric generator provided within the flow passage of the faucet.

23. A controller apparatus for a faucet, as defined in claim 1, wherein said electric power generation means is a solar battery provided on or in vicinity of a main body of the faucet.

24. A controller apparatus for a faucet, as defined in claim 1, wherein said electric power generation means is a thermal power generating element thermally connected to the flow passage of the faucet.

25. A controller apparatus for a faucet, as defined in claim 1, wherein said electric power generation means is a combination of at least two selected from a hydroelectric generator provided within the flow passage of the faucet, a solar battery provided on or in vicinity of a main body of the faucet, and a thermal power generating element thermally connected to the flow passage of the faucet.

26. A controller apparatus for a faucet, as defined in claim 22, wherein said electric power generation means is constructed to be exchangeable with another electric power generation means.

27. A controller apparatus for a faucet, as defined in claim 22, wherein at an output of said electric power generation means is provided an output voltage restriction circuit.

28. A controller apparatus for a faucet, as defined in claim 22, further comprising an electric power consumption circuit, and an exchanger means for connecting either of said capacitor and said electric power consumption circuit to an output of the generator.

29. A controller apparatus for a faucet, as defined in claim 28, wherein said exchanger means is controlled depending on charge voltage of said capacitor.

30. A controller apparatus for a faucet, comprising:

a hydroelectric generator provided within a flow passage of the faucet;

an electricity storage means charged by said generator;

a faucet controller circuit operated with supply of electricity from said electricity storage means;

an electromagnetic valve for opening or closing the flow passage by said faucet controller circuit;

an electric power consumption circuit; and an exchanger means for connecting either of said electric power consumption circuit and said electricity storage means to an output of said generator, wherein said exchanger means connects either of the electric power consumption circuit and the electricity storage means depending on charge voltage of said electricity storage means.

31. A controller apparatus for a faucet, comprising:

a faucet controller configure to control an operation of the faucet;

a voltage converter configured to convert a voltage across a capacitor to a predetermined voltage and to supply the converted voltage to the faucet controller;

a valve configured to open and close a flow passage in the faucet based on control commands received from the faucet controller;

an electric power generator attached to a water wheel provided in the water passage and configured to charge the capacitor when the flow passage is open and water is flowing through the flow passage;

a primary battery connected between the electric power generator and the capacitor; and a switch disposed between an output of the primary battery and the capacitor, wherein the faucet controller controls the switch to open and close so as to control a charging process from the primary battery to the capacitor such that the capacitor is charged either by the electric power generator or the primary battery.

32. A controller apparatus for a faucet, as defined in claim 31, wherein said faucet controller controls the charging process depending on a voltage across said capacitor.

33. A controller apparatus for a faucet, as defined in claim 31, wherein said faucet controller turns the switch off to restrict a supply of electricity from said primary battery to said faucet controller circuit.

34. A controller apparatus for a faucet, as defined in claim 31, wherein said faucet controller turns off the switch when a voltage of the capacitor is above a predetermine value and turns on the switch when the voltage of the capacitor is below the predetermined value.

35. A controller apparatus for a faucet, as defined in claim 31, wherein the switch is a transistor or an impedance changing switch.

* * * * *